US007114582B2

(12) United States Patent
Eppink et al.

(10) Patent No.: US 7,114,582 B2
(45) Date of Patent: Oct. 3, 2006

(54) METHOD AND APPARATUS FOR REMOVING CUTTINGS FROM A DEVIATED WELLBORE

(75) Inventors: Jay M. Eppink, Spring, TX (US); Brent E. Phillips, Houston, TX (US); James W. Estep, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/676,858

(22) Filed: Oct. 1, 2003

(65) Prior Publication Data

US 2004/0112645 A1 Jun. 17, 2004

Related U.S. Application Data

(60) Provisional application No. 60/416,020, filed on Oct. 4, 2002.

(51) Int. Cl.
*E21B 21/06* (2006.01)

(52) U.S. Cl. ..... 175/61; 175/207; 166/313

(58) Field of Classification Search ..... 166/311, 166/312; 175/61, 62, 215, 73, 95
See application file for complete search history.

(56) References Cited

U.S. PATENT DOCUMENTS

| | | | |
|---|---|---|---|
| 2,765,146 | A | 10/1956 | Williams, Jr. |
| 2,833,517 | A | 5/1958 | Bobo |
| 3,823,788 | A | 7/1974 | Garrison et al. |
| 4,373,582 | A | 2/1983 | Bednar et al. |
| 4,436,166 | A | 3/1984 | Hayatdavoudi et al. |
| 4,844,182 | A | 7/1989 | Tolle |
| 5,074,366 | A | 12/1991 | Karlsson et al. |
| 5,269,377 | A | 12/1993 | Martin |
| 5,318,137 | A | 6/1994 | Johnson et al. |
| 5,318,138 | A | 6/1994 | Dewey et al. |
| 5,332,048 | A | 7/1994 | Underwood et al. |
| 5,465,787 | A | 11/1995 | Roth |
| 5,536,183 | A | 7/1996 | Brandolf |
| 5,627,343 | A | 5/1997 | Brandolf |
| 5,730,222 | A | 3/1998 | Rike, Jr. |
| 5,732,776 | A | 3/1998 | Tubel et al. |
| 5,909,098 | A | 6/1999 | Konecny et al. |
| 5,979,572 | A | 11/1999 | Boyd et al. |
| 5,984,011 | A | 11/1999 | Misselbrook et al. |
| 5,988,992 | A | 11/1999 | Tetzlaff et al. |
| 6,043,995 | A | 3/2000 | Leuthen |

(Continued)

OTHER PUBLICATIONS

International Search Report for Application No. PCT/US03/31211 dated Apr. 27, 2005; (4 p.).

(Continued)

*Primary Examiner*—Frank Tsay
(74) *Attorney, Agent, or Firm*—Conley Rose, PC

(57) ABSTRACT

Apparatus and methods for diverting a portion of the drilling fluid that flows into a drilling assembly comprise diverting the drilling fluid into the annulus of a deviated wellbore at a flow rate corresponding to a velocity that is sufficient to transport cuttings to the surface while drilling progresses. The diverted drilling fluid is directed into the annulus at an angle to prevent erosion of the wellbore wall. The flow rate of the diverted drilling fluid is controlled to establish a fixed flow rate, or alternatively, a variable flow rate. Pressure is dissipated and fluid velocity is reduced as the diverted drilling fluid flows between a high fluid pressure within the drilling assembly to a lower pressure in the wellbore annulus.

67 Claims, 27 Drawing Sheets

U.S. PATENT DOCUMENTS

| | | | |
|---|---|---|---|
| 6,105,690 | A | 8/2000 | Biglin, Jr. et al. |
| 6,296,066 | B1 | 10/2001 | Terry et al. |
| 6,488,104 | B1 | 12/2002 | Eppink et al. |
| 6,607,044 | B1 | 8/2003 | Eppink et al. |
| 6,659,200 | B1 | 12/2003 | Eppink |
| 2002/0007970 | A1 | 1/2002 | Terry et al. |

OTHER PUBLICATIONS

SPE/CoTA Coiled Tubing Roundtable (SPE 54469); *The All Electric BHA: Recent Developments Toward an Intelligent Coiled-Tubing Drilling System*; D. Turner, et al.; May 25-26, 1999; (pp. 1-10).

SPE/CoTA Coiled Tubing Roundtable (SPE 68441); *Electric Coiled Tubing Drilling (E-CTD) Project Updated*; P Head, et al.; Mar. 7-8, 2001; (pp. 1-9).

SPE/CoTA Coiled Tubing Roundtable (SPE 68489); *New DC Motor for Downhole Drilling and Pumping Applications*; D. Turner, et al.; Mar. 7-8, 2001; (pp. 1-7).

SPE/CoTA Coiled Tubing Roundtable (SPE 68507); *Slimclearance-Small Diameter Reeled Exploration Wells and Conventional Wellss*; P. Head, et al.; Mar. 7-8, 2001; (pp. 1-5).

XL Technology Ltd.; *Downhole Vacuum Cleaning Service*; (Undated) (pp. 1).

METHOD AND APPARATUS FOR REMOVING CUTTINGS FROM A DEVIATED WELLBORE

CROSS-REFERENCE TO RELATED APPLICATIONS

The present application claims the benefit under 35 U.S.C. Section 119(e) of provisional application Ser. No. 60/416,020 filed Oct. 4, 2002, and entitled "Method and Apparatus for Removing Cuttings from a Deviated Wellbore".

STATEMENT REGARDING FEDERALLY SPONSORED RESEARCH OR DEVELOPMENT

Not Applicable.

BACKGROUND

1. Field of the Invention

The present invention relates generally to methods and apparatus for removing cuttings from a deviated wellbore, and more particularly, to methods and apparatus for diverting drilling fluid into a wellbore annulus to remove cuttings from a deviated wellbore as drilling progresses.

2. Description of the Related Art

Historically, oil and gas were produced from hydrocarbon formations by drilling a substantially vertical wellbore from a surface location above the formation to the desired hydrocarbon zone at some depth below the surface. Modern drilling technology and techniques allow for the drilling of wellbores that deviate from vertical. In particular, deviated or horizontal wellbores may be drilled from a convenient surface location to the desired hydrocarbon zone. It is also common to drill "sidetrack" boreholes within existing wellbores to access other hydrocarbon formations.

During such drilling operations, it may be economically infeasible to use jointed drill pipe. Therefore, tools and methods have been developed for drilling wellbores using coiled tubing, which is a single length of continuous, unjointed tubing spooled onto a reel for storage in sufficient quantities to exceed the length of the wellbore. A typical drilling operation is depicted in FIG. 1, which includes a coiled tubing system 100 on the surface 10 and a drilling assembly 200 shown drilling a subsurface deviated wellbore 170. The coiled tubing system 100 includes a power supply 110, a surface processor 120, and a coiled tubing spool 130. An injector head unit 140 feeds and directs the coiled tubing 150 from the spool 130 into the well 160. The drilling assembly 200, which includes a drilling motor 205 and a drill bit 210, connects to the lower end of the coiled tubing 150 and extends into the deviated wellbore 170 being drilled.

The drilling motor 205 operates the drill bit 210, which cuts into the wellbore wall 175, thereby creating cuttings 180 that tend to accumulate in the wellbore annulus 165 formed between the coiled tubing 150 and the wall 175 of the deviated wellbore 170. The drilling motor 205 is powered by drilling fluid pumped from the surface 10 through the coiled tubing 150. The drilling fluid flows through the drilling motor 205, out through the drill bit 210, and into the wellbore annulus 165 back up to the surface 10.

When using drill pipe that rotates during the drilling process, cuttings 180 do not tend to accumulate in the annular area 165 of the wellbore 170. The rotation of the pipe working against the cuttings 180 tends to stir up the cuttings 180 so that they are more easily carried away by the drilling fluid as it flows through the wellbore annulus 165 to the surface 10. However, when drilling using coiled tubing 150, which does not rotate, the cuttings 180 tend to accumulate in the wellbore annulus 165 and may even bury the coiled tubing 150. Therefore, when using coiled tubing 150 to drill a deviated wellbore 170, it is particularly important for the drilling fluid to flow through the wellbore annulus 165 at a velocity sufficient to lift the cuttings 180 and carry them back to the surface 10. However, the components of the drilling assembly 200 have smaller internal diameters than the coiled tubing 150, so excessive drilling fluid velocities must be avoided to prevent erosion or abrasion of the internal components of the drilling assembly 200.

Thus, one method for removing cuttings 180 from a deviated wellbore 170 is to periodically perform wiper trips. To conduct a wiper trip, drilling is halted, and the coiled tubing 150 is pulled to drag the drilling assembly 200 through the previously drilled wellbore 170 to stir up the cuttings 180 so that the drilling fluid can carry those cuttings 180 back to the surface 10. Wiper trips are undesirable because they consume valuable drilling time and can cause damage to the components of the drilling assembly 200, such as the drill bit 210.

U.S. Pat. No. 5,984,011 to Misselbrook et al., hereby incorporated herein by reference for all purposes, discloses another method for removing cuttings from a deviated wellbore without using wiper trips. The method includes ceasing drilling, pumping fluid into the wellbore at a critical level of flow that exceeds the drilling flow rate, and valving at least a portion of the fluid to bypass the drilling motor, preferably in the vicinity of the drilling motor.

Misselbrook teaches that drilling is ceased so that additional cuttings are not generated while removing the existing cuttings from the wellbore. The critical level of flow is typically 3–5 feet/second, or at least 120% of the drilling flow rate, and possibly up to 150% of the drilling flow rate. At the critical level of flow, approximately 60 linear feet/minute can be cleared without drilling as compared to a wiper trip, which typically does not proceed at a rate greater than 50 feet/minute, and usually proceeds slower. Further, with drilling ceased, the weight-on-bit can be managed to cause the coiled tubing to helix or cork screw within the wellbore, thereby lifting substantial portions of the coiled tubing off the wellbore wall to enhance cutting removal. In summary, the Misselbrook method includes ceasing drilling, opening a valve, and increasing the flow rate to a critical level to bypass the drilling motor and sweep out any cuttings that have accumulated in the wellbore. The cutting removal phase may be enhanced by helixing the coiled tubing within the wellbore.

U.S. Pat. No. 5,979,572 to Boyd et al., hereby incorporated herein by reference for all purposes, discloses a by-pass valving apparatus that enables removal of cuttings from a wellbore drilled using either conventional drill pipe or coiled tubing. The valving arrangement comprises an outer body with an inner spool mounted therein, motion control means to effect uni-directional rotation of the spool through pre-set positions, and a spring that biases the spool to a closed-off position. Fluid pumped through the drill string from the surface moves the spool against the spring, while simultaneously; the motion control means causes the spool to rotate to a pre-set position. Relieving the fluid pressure causes the spool to move axially with the spring and to rotate via the motion control means to the closed-off position. Subsequent pumping of fluid through the drill string causes the spool to move axially and to rotate to yet another pre-set position. In this way, the spool is selectively moved through a number of pre-set positions that close off flow, or direct fluid entirely or partially into the wellbore.

Boyd teaches that except during drilling, it is desirable to suspend operation of the drill motor and telemetry equipment to prolong its useful operating life. Therefore, the by-pass valving arrangement is positioned upstream of the motor and telemetry equipment so that fluid may be circulated into the wellbore while bypassing the drilling equipment. In circumstances where the bit might become stuck in the hole, the flow may be partially by-passed through the valving arrangement so that a reduced flow rotates the drill motor at a slower rate. Boyd states that use of the flow control tool allows for increased mud flow rates during circulating operations, thereby reducing the mud circulating time and increasing the removal efficiency of the cuttings. Further, use of the tool provides an increased motor life since not all of the mud flowing at the higher circulating rates must pass through the motor.

The apparatus and methods disclosed by Misselbrook and Boyd each eliminate the need for wiper trips, but each recommends disrupting drilling to sweep the wellbore clean of cuttings. Thus, it would be desirable to provide a cutting removal apparatus and method that does not disrupt drilling. Accordingly, it would be desirable to provide a continuous cutting removal apparatus and method that operates while drilling proceeds.

The present invention overcomes the deficiencies of the prior art.

SUMMARY

The present invention features a diverter sub for use within a drilling assembly. The sub diverts drilling fluid into the annulus of a deviated wellbore to transport cuttings to the surface while drilling progresses. The diverter sub comprises a dissipater assembly that dissipates a pressure differential as the diverted drilling fluid flows between high pressure in the diverter sub to lower pressure in the wellbore annulus.

In one embodiment, the present invention removes cuttings from a deviated wellbore as it is being drilled using a non-rotating drill string. The apparatus in the one embodiment comprises a diverter that directs a fluid through a dissipater and into the deviated wellbore to remove cuttings while drilling of the wellbore progresses, and the dissipater expends a pressure differential as the fluid flows therethrough.

Thus, the present invention comprises a combination of features and advantages that enable it to overcome various problems of prior systems. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the various embodiments of the present invention, reference will now be made to the accompanying drawings, wherein.

DETAILED DESCRIPTION

In one embodiment, the present invention comprises apparatus and methods for diverting drilling fluid into a wellbore annulus to continuously carry cuttings to the surface while drilling the wellbore. The present invention is particularly well suited for deviated wellbores that are drilled using non-rotating drill pipe, such as coiled tubing, where cuttings tend to accumulate in the wellbore annulus around the drill string as the wellbore is being drilled. A "deviated" wellbore, as used herein, indicates a wellbore that is substantially non-vertical, such that cuttings are likely to accumulate, such as wellbores having an angle greater than 30° from vertical.

Figure 1:
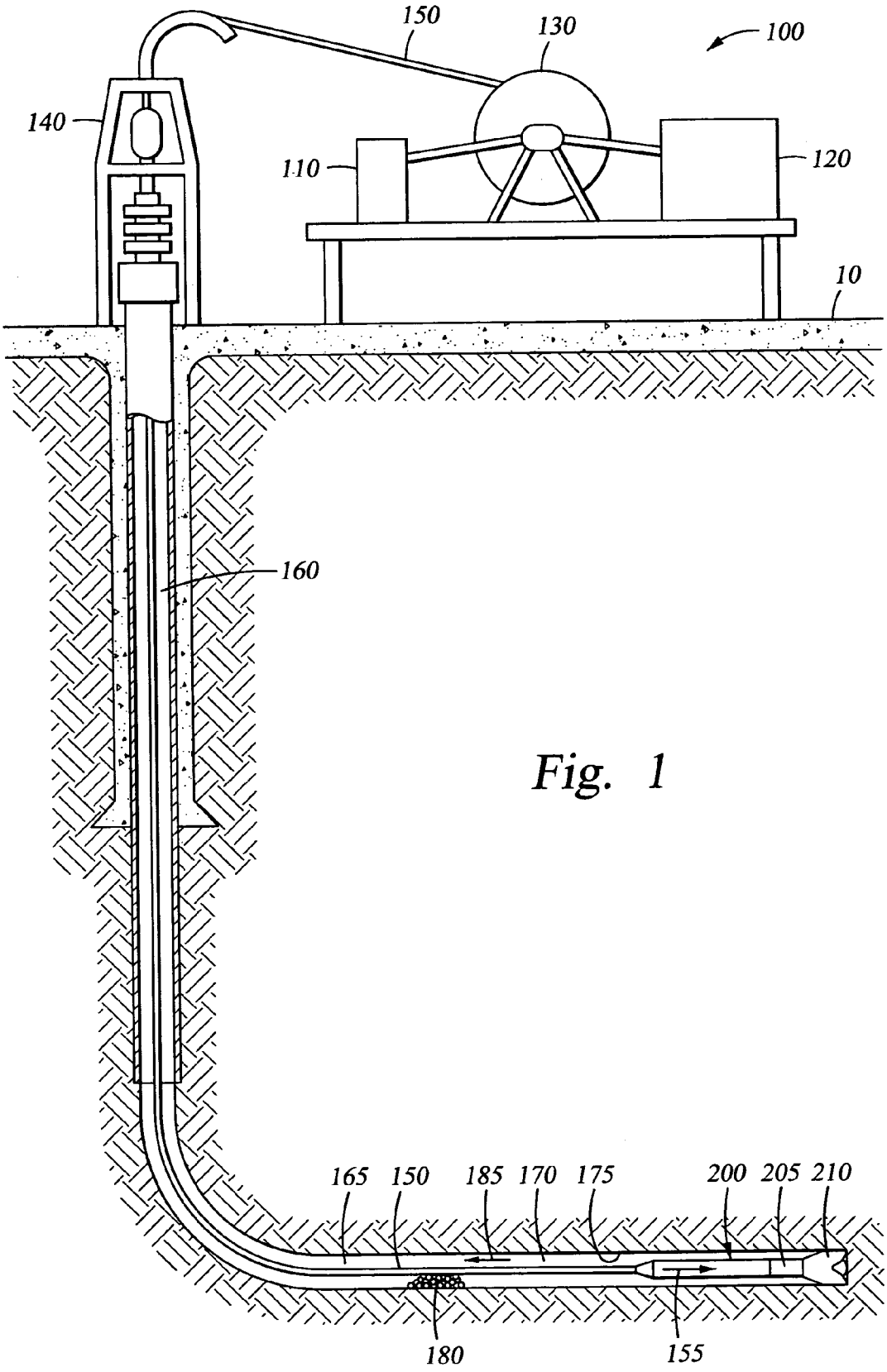
FIG. 1 is a schematic, partially in cross-section, illustrating a typical coiled tubing drilling operation where an accumulation of cuttings has formed within a deviated wellbore.

Referring again to FIG. 1, during a typical drilling operation, drilling fluid flows through the coiled tubing 150 and into the drilling assembly 200 along path 155 to power the drilling motor 205 and drill bit 210. After exiting the drill bit 210, the drilling fluid flows back to the surface 10 along path 185 through the wellbore annulus 165 formed between the coiled tubing 150 and the wellbore wall 175. As the drilling fluid flows along path 185, it must have a minimum annular velocity to lift the cuttings 180 that accumulate in the wellbore annulus 165 and carry them back to the surface 10. This minimum annular velocity will vary, as for example, with wellbore inclination, size of the cuttings 180, geometry of the deviated wellbore 170, and drilling fluid properties.

The drilling motor 205 is powered by drilling fluid pumped from the surface 10 through the coiled tubing 150, and the drilling motor 205 is designed to operate within a specific flow rate range. Although the surface pumps can deliver drilling fluid at high flow rates, the drilling motor 205 is limited to a maximum operational flow rate, beyond which the motor 205 will experience early failure. Likewise, the drilling assembly 200 is designed for a maximum operational flow rate corresponding to a maximum fluid velocity, beyond which erosion or abrasion will occur. The components of the drilling assembly 200 have smaller internal diameters than the coiled tubing 150, such that the highest fluid velocities will occur in these small areas based on the relationship: Velocity=Flow Rate/Flow Area. Thus, for a given flow rate, the smaller the flow area, the higher the fluid velocity. Accordingly, the size of the drilling assembly 200 components limits the drilling fluid flow rate to a predetermined maximum, corresponding to a maximum velocity beyond which erosion or abrasion of the drilling assembly 200 will occur. Accordingly, the maximum flow rate of the drilling fluid flowing along path 155 through the drilling assembly 200 is limited by operational considerations. If this maximum operational flow rate does not correspond to at least the minimum annular flow velocity required to carry the cuttings 180 to the surface 10, the cuttings 180 will continue to accumulate in the wellbore annulus 165.

Therefore, various embodiments of the present invention are directed to providing at least the minimum annular flow velocity required to carry the cuttings 180 to the surface 10 while simultaneously providing a predetermined operational flow velocity to the drilling assembly 200 that is less than the maximum. Further, these embodiments are directed to continuously sweeping cuttings 180 to the surface 10 while the drilling assembly 200 continues to drill the deviated wellbore 170.

Figure 2:
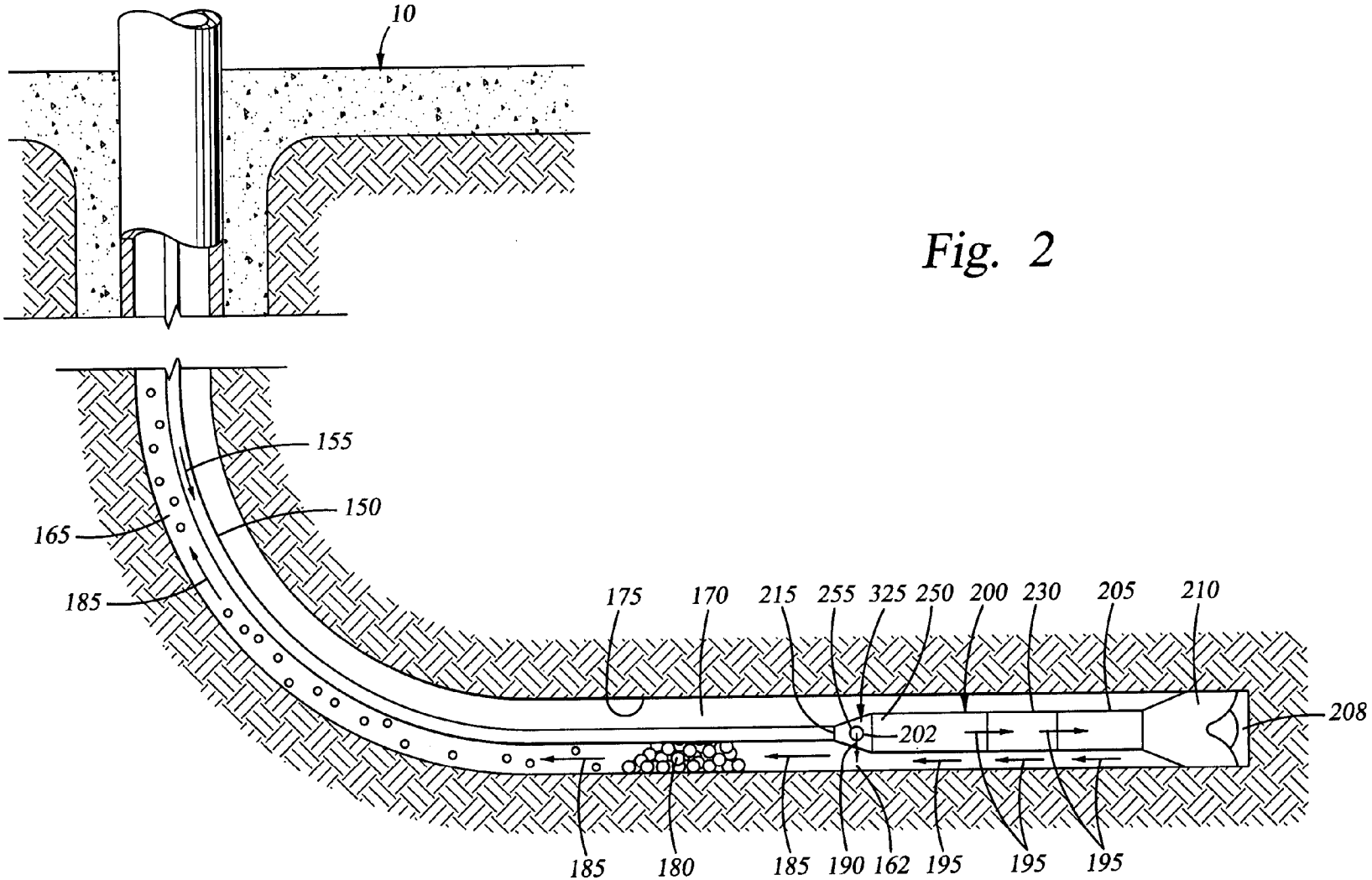
FIG. 2 is an enlarged schematic, partially in cross-section, illustrating the general operation of one embodiment of the present invention within a coiled tubing drilling operation forming a deviated wellbore.

Referring now to FIG. 2, where like components are identified by like reference numerals, an exemplary drilling assembly 200 is shown drilling a deviated wellbore 170. The drilling assembly 200 includes a diverter sub 250 that may be separated by one or more drilling assembly components 230 from the drilling motor 205 and drill bit 210. One embodiment of the diverter sub 250 includes at least one diverter port 255 for diverting a portion of the drilling fluid into the wellbore annulus 165. When the drilling fluid flowing along path 155 reaches the diverter port 255, a portion of the drilling fluid is diverted and directed along path 190 into the wellbore annulus 165. The non-diverted portion of the drilling fluid travels in a circuit along path 195 through the drilling assembly components 230, drilling motor 205, and out through the drill bit 210 into the wellbore annulus 165. The non-diverted drilling fluid then flows up the wellbore annulus 165 to a point near the top of the drilling assembly 200 where it joins the diverted drilling fluid flowing along path 190. Once the non-diverted and the diverted drilling fluid join together, the total fluid flow rate is directed upwardly through the wellbore annulus 165 at a sufficient annular velocity to carry the cuttings 180 to the surface 10.

The diverter sub 250 may be connected directly to the coiled tubing 150, with the diverter port 255 located at or near the connection point 215 with the coiled tubing 150. This positioning is desirable because the internal diameters of the drilling assembly 200 components below the connection point 215 are typically smaller, thereby reducing the flow area and increasing the flow velocity for the same drilling fluid flow rate. Therefore, by diverting fluid at or near the connection point 215 with the coiled tubing 150, the flow rate and corresponding flow velocity for the non-diverted portion of the fluid is reduced before reaching the smaller components of the drilling assembly 200.

In one example, if drilling fluid flowing at ninety gallons per minute (90 GPM) is preferable to operate the drilling assembly 200, and drilling fluid flowing at 140 GPM is preferable to carry cuttings 180 to the surface, drilling fluid flowing at 140 GPM can be pumped through the coiled tubing 150 along path 155. When the 140 GPM reaches the diverter sub 250, the diverter port 255 is sized to divert 50 GPM along path 190 into the wellbore annulus 165 such that 90 GPM continues along path 195 out through the drill bit 210 and into the wellbore annulus 165. The 90 GPM flowing along path 195 will rejoin in the wellbore annulus 165 with the 50 GPM flowing along path 190, and the total 140 GPM drilling fluid will flow along path 185 in the wellbore annulus 165 back up to the surface 10.

The diverter sub 250 may also include a dissipating assembly, generally designated as 325, which dissipates the energy of the diverted drilling fluid. The energy is due to the pressure differential between the higher interior pressure, such as at point 202, and the lower wellbore pressure, such as at point 162. The pressure differential between points 202 and 162 is primarily due to the obstructions to flow presented by the drilling assembly 200. Namely, the drilling assembly 200 extends past the connection point 215 for a significant distance, such as 120 feet, for example, and includes various passageways through which the drilling fluid must traverse along path 195. Therefore, a large internal pressure drop exists between point 202 at the diverter port 255 and point 208 in the wellbore annulus 165 just downstream of the drill bit 210. To supply drilling fluid to the drill bit 210 at 90 GPM, for example, the pressure at point 202 at the diverter port 255 is approximately 1,800 psi greater than the pressure at point 208 due to the large internal pressure drop through the drilling assembly 200. The pressure drop between points 202 and 208 is a close approximation to the pressure differential between points 202 and 162. Therefore, if the diverter port 255 is located at or near the connection 215, the pressure within the drilling assembly 200 at point 202 is approximately 1,800 psi greater than the pressure at point 162 in the wellbore annulus 165. The pressure drop can exceed 1,800, and can reach 2,200 psi for short periods, such as when the surface pump speed is being adjusted.

The pressure differential between points 202 and 162 represents energy in the form of hydraulic horsepower that must be dissipated as the diverted drilling fluid flows along path 190 into the wellbore annulus 165. If this energy is not dissipated in a controlled way, the diverted drilling fluid will escape as a jet of high velocity, high-pressure fluid along path 190. This jet can erode the wall of the drilling assembly 200 and trench the wellbore wall 175 in the vicinity of the diverter sub 250. Thus, the diverter sub 250 preferably includes a dissipating assembly 325 to dissipate the energy associated with the pressure differential between points 202 and 162.

The dissipating assembly 325 of the diverter sub 250 generally comprises a tortuous flow path through which the diverted drilling fluid must traverse as it flows along path 190. The differential pressure between points 202 and 162 determines the required tortuosity of the dissipating assembly 325. This differential pressure defines the energy that must be dissipated, typically ranging up to approximately 1,800 psi. Thus, the dissipating assembly 325 presents a tortuous flow path that restricts the flow therethrough such that up to approximately 1,800 psi of pressure is expended as the drilling fluid flows along path 190 between points 202 and 162. One limitation with respect to the dissipating assembly 325 is that it cannot present a tortuous flow path with passageways so small that the velocity of the drilling fluid erodes the dissipating assembly 325. Accordingly, the various embodiments of the dissipating assembly 325 are not defined by a particular structure. In fact, the dissipating assembly 325 may be provided in a number of different configurations, as further described below.

Figure 3:
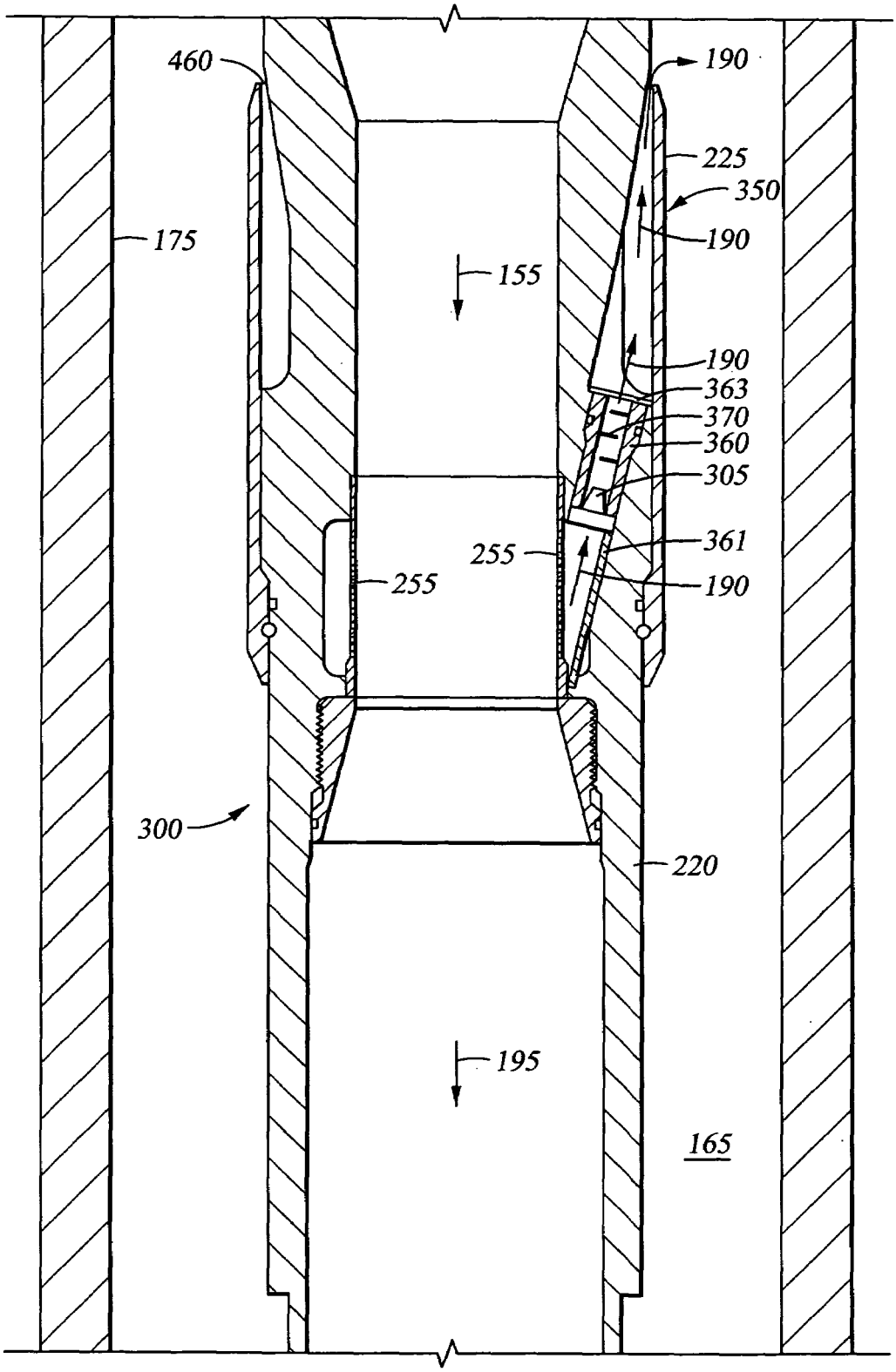
FIG. 3 is a cross-sectional schematic illustrating one embodiment of the present invention.

FIG. 3 depicts an enlarged cross-sectional view of one exemplary diverter sub 300 including one exemplary dissipating assembly 350. In this embodiment, the diverter sub 300 includes one or more diverter ports 255 through the housing 220 of the diverter sub 300. The flow rate control of the fluid diverted along path 190 may be provided by fitting each diverter port 255 with one or more exchangeable flow nozzles 305 that can be replaced at the surface to vary the flowrate. In one embodiment of the diverter sub 300, three diverter ports 255 are disposed 120 degrees apart circumferentially around the diverter sub 300, each diverter port 255 being fitted with a flow sleeve 361 that directs flow from the diverter port 255 to at least one exchangeable nozzle 305. The flow sleeves 361 are designed to fit over each diverter port 255 such that the number and position of the flow sleeves 361 corresponds to the number and position of the diverter ports 255. Each flow sleeve 361 is preferably disposed at an angle, such as 60 degrees or more, to prevent trenching of the wellbore wall 175 as the diverted drilling fluid moves along path 190 into the wellbore annulus 165. This angle also provides a parallel component of flow in the direction of the preferred flow of the cuttings through the wellbore annulus 165.

This embodiment of the diverter sub 300 also includes an exemplary dissipating assembly 350 that provides obstructions to the diverted flow, such as one or more baffle sleeves 360 having obstruction baffles 370 disposed therein. Alternatively, a nozzle 305 or series of nozzles 305 may be provided alone or in combination with the baffles 370 to dissipate pressure. The baffle sleeves 360 and nozzles 305 may be held in position with respect to the housing 220 in a variety of ways, such as via a snap ring 363 as shown in FIG. 3. Alternatively, the baffle sleeves 360 and nozzles 305 may threadingly connect to the housing 220, or may be disposed within a retaining sleeve (not shown) that threadingly connects to the housing 220. If a threaded connection is made, the snap ring 363 may provide a secondary attaching means. A barrier cylinder 225 may optionally be connected to the housing 220 of the diverter sub 300. The baffles 370 dissipate the differential pressure as the drilling fluid traverses the baffle sleeve 360, and the optional barrier cylinder 225 creates an additional obstacle to dissipate pressure before the fluid flows through ports 460 into the wellbore annulus 165. The diameter and length of the flow sleeves 361, the diameter and length of the baffle sleeves 360, the size and quantity of baffles 370, and the length of the barrier cylinder 225 all combine to determine the amount of energy dissipated.

Figure 29:
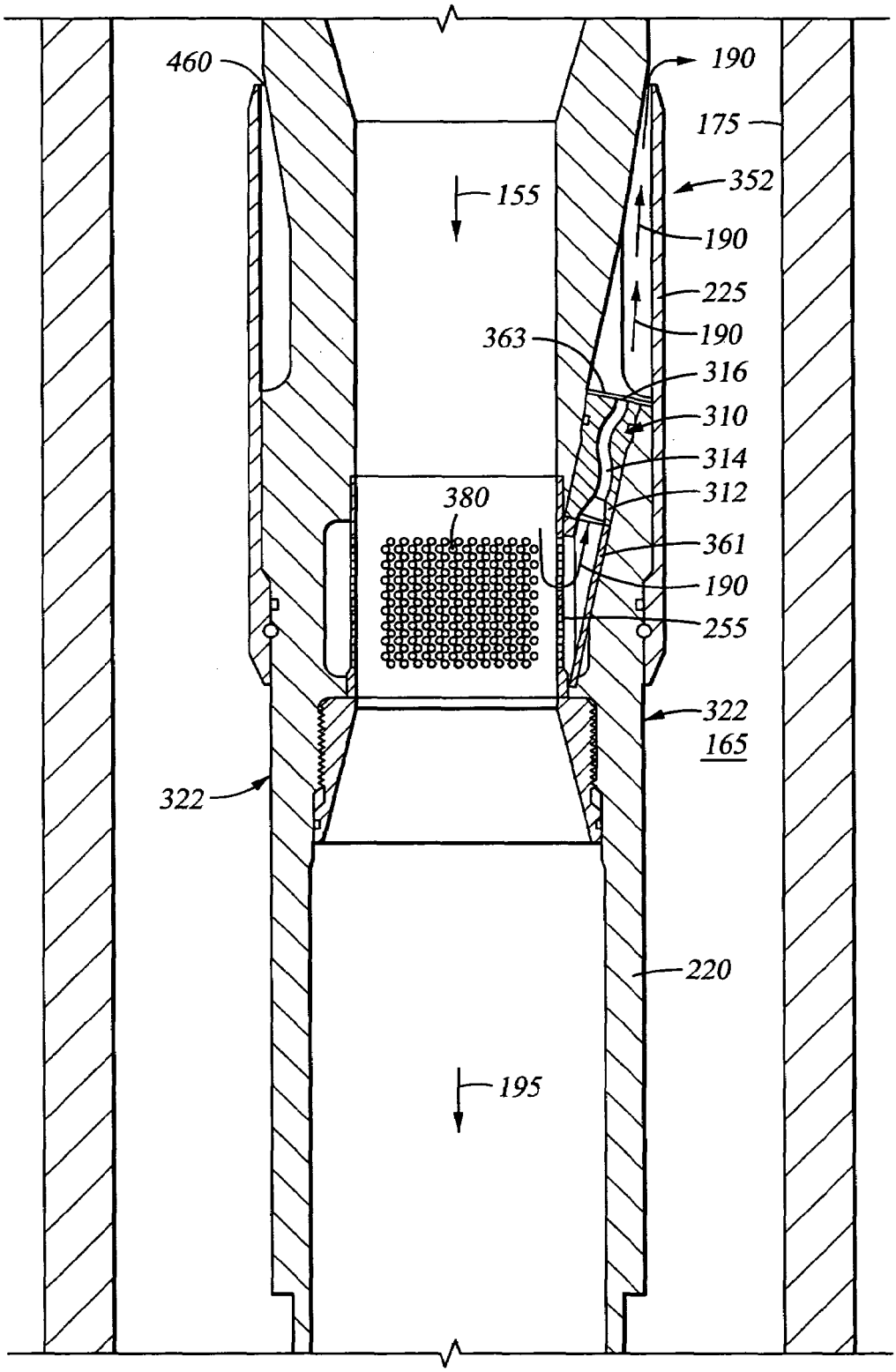
FIG. 29 is a cross-sectional schematic illustrating another embodiment of the present invention.

FIG. 29 depicts another exemplary diverter sub 322 including another exemplary dissipating assembly 352. In this embodiment, the diverter sub 322 preferably includes one or more diverter ports 255, and preferably a screen 380 is provided to extend across the diverter ports 255 to prevent solid particles of a particular size from entering the dissipating assembly 352. The exemplary dissipating assembly 352 includes one or more flow sleeves 361 disposed at an angle and fitting over each diverter port 255, one or more tortuous nozzles 310 that connect to the end of the flow sleeves 361, and optionally, a barrier cylinder 225. As one of ordinary skill in the art will recognize, a variety of other configurations may also be provided, such as, for example, connecting the tortuous nozzles 310 directly into the diverter ports 255. As another example, additional nozzles 310 may be provided longitudinally in series, such that the diverted flow is routed along path 190 through the series of nozzles 310.

Figure 30:
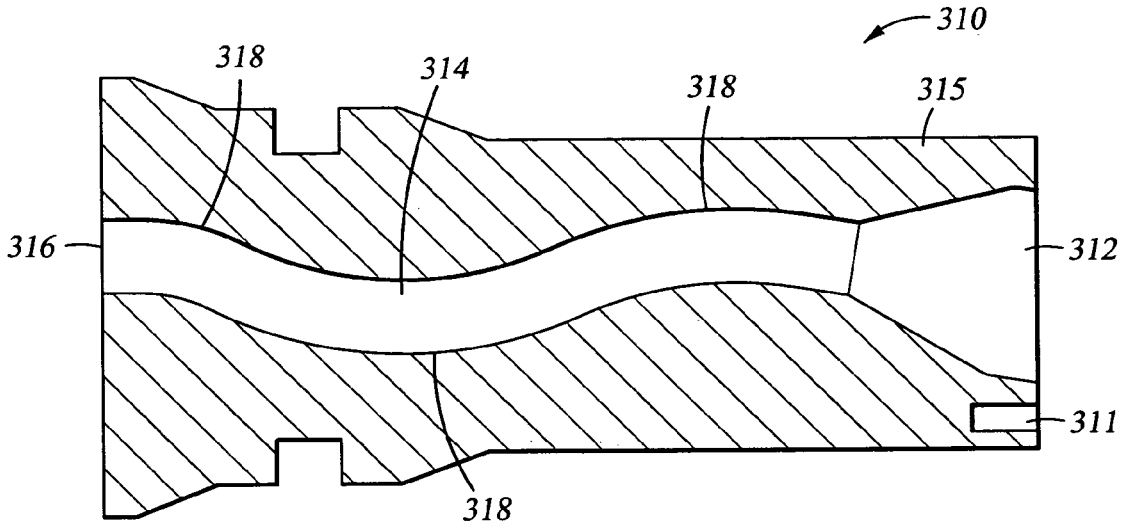
FIG. 30 is a cross-sectional side view of a tortuous nozzle.
Figure 31:
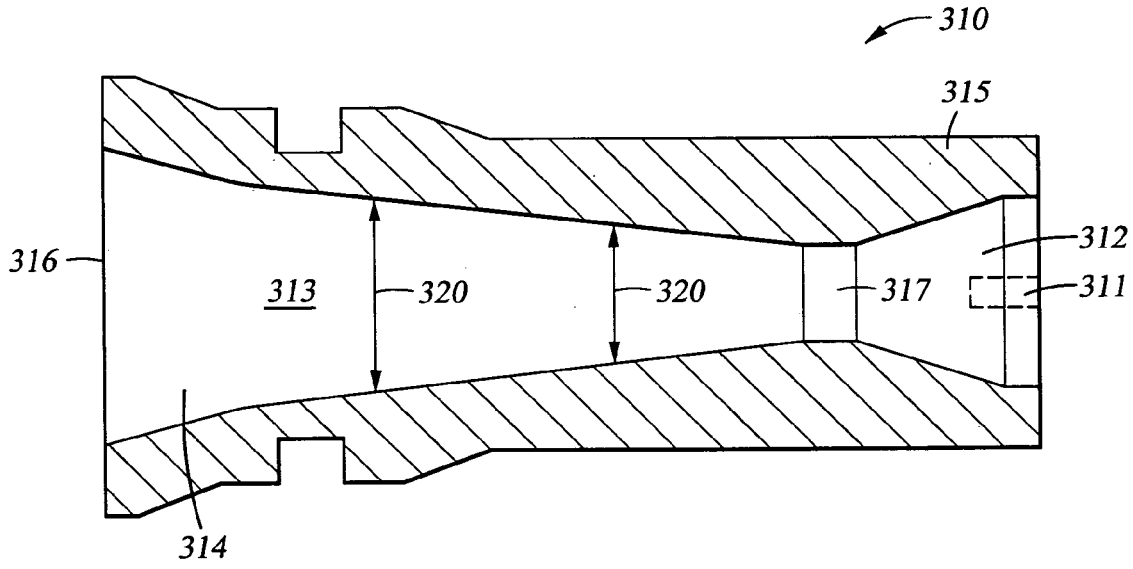
FIG. 31 is a cross-sectional top view of the tortuous nozzle of FIG. 30.

FIG. 30 and FIG. 31 depict an enlarged cross-sectional side view and an enlarged cross-sectional top view, respectively, of the tortuous nozzle 310 of FIG. 29. The tortuous nozzle 310 comprises a body 315 with a port 311 for accepting a pin (not shown) to connect the nozzle 310 to a flow sleeve 361 or another component. The nozzle 310 also includes a flowbore 313 extending therethrough comprising a conical inlet section 312, an orifice section 317, a dissipating section 314, and an exit end 316. The dissipating section 314 may present a series of turns 318 that provide no line of sight between the inlet section 312 and the exit end 316 such that flow is obstructed as it moves therethrough. As shown in FIG. 31, the dissipating section 314 may have a widening internal diameter 320 between the orifice section 317 and the exit end 316. The tortuous nozzle 310 is provided to dissipate pressure and may be provided alone or in combination with other components.

Referring again to FIG. 29, in operation the diverted drilling fluid flows along path 190, through the diverter port 255, through the flow sleeve 361, and into the tortuous nozzle 310. The series of turns 318 in the dissipating section 314 of the nozzle 310 dissipates any jetting action from the inlet end 312 to the exit end 316. Thus, the turns 318 in the dissipating section 314 obstruct the flow and reduce fluid velocities, thereby preventing trenching of the wellbore wall 175 when the drilling fluid moves into the wellbore annulus 165. If a series of nozzles 310 is provided, each nozzle 310 would further reduce the pressure of the diverted flow as it traverses the dissipating assembly 352. The barrier cylinder 225 may optionally be provided as an additional obstacle to the fluid as it exits the tortuous nozzle 310 or nozzles 310, in which case the fluid will enter the wellbore annulus 165 through ports 460. The length of the flowbore 313, the diameter 320 of the dissipating section 314, and the tortuosity of the turns 318 in the dissipating section 314, determine the amount of energy dissipated in the nozzle 310 or nozzles 310. If the barrier cylinder 225 is provided, the length of the cylinder 225 determines the additional energy dissipated before the diverted fluid flows through ports 460 into the wellbore annulus 165.

Figure 32:
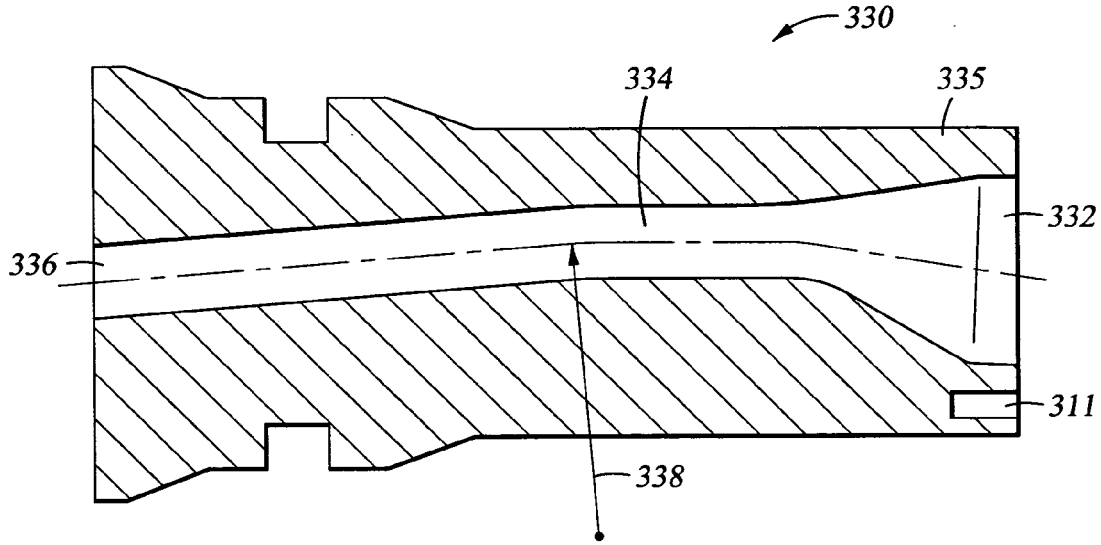
FIG. 32 is a cross-sectional side view of a curved nozzle.
Figure 33:
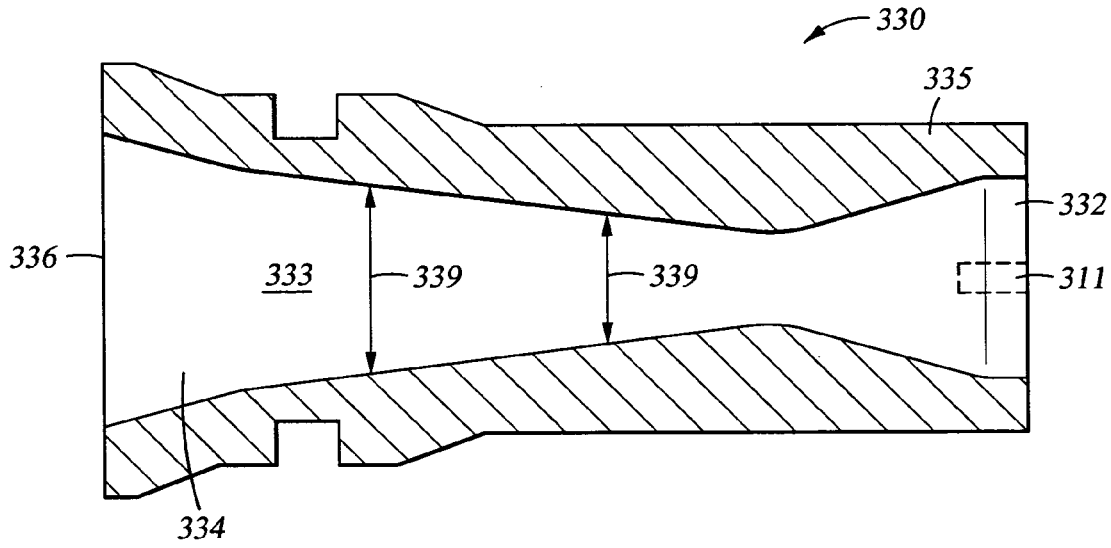
FIG. 33 is a cross-sectional top view of the curved nozzle of FIG. 32.

The tortuous nozzle 310 may be provided in various alternate configurations. For example, FIG. 32 and FIG. 33 depict an enlarged cross-sectional side view and an enlarged cross-sectional top view, respectively, of a curved nozzle 330 that could be used in place of the tortuous nozzle 310 in the diverter sub 322 of FIG. 29. The curved nozzle 330 comprises a body 335 with a port 311 for accepting a pin (not shown) to connect the nozzle 330 to a flow sleeve 361 or another component. The nozzle 330 also includes a flowbore 333 extending therethrough comprising a conical inlet section 332, a dissipating section 334, and an exit end 336. The dissipating section 334 may present a curved flow path that diverts the direction of the fluid flowing along path 190 off-center, thereby reducing the velocity of the fluid as it moves through dissipating section 334. The dissipating section 334 includes a continuous radius 338 that is as large as possible to reduce impingement of the fluid flow on the walls of the dissipating section 334 to prevent erosion. As shown in FIG. 33, the dissipating section 334 may have a widening internal diameter 339. The curved nozzle 330 is provided to dissipate pressure and may be provided alone or in combination with other components.

Figure 44:
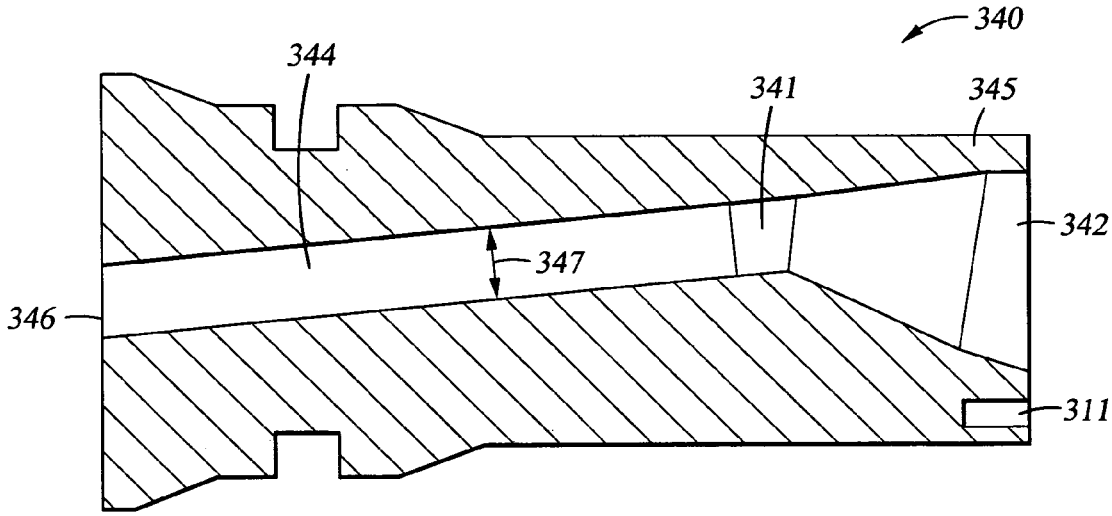
FIG. 44 is a cross-sectional side view of an angled nozzle.
Figure 45:
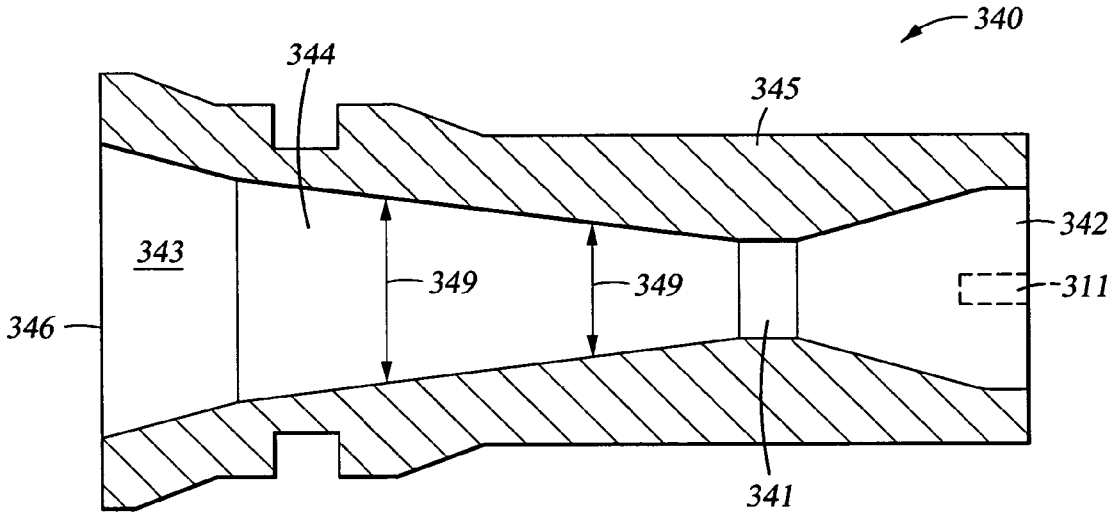
FIG. 45 is a cross-sectional top view of the angled nozzle of FIG. 44.

In yet another configuration, FIG. 44 and FIG. 45 depict an enlarged cross-sectional side view and an enlarged cross-sectional top view, respectively, of an angled nozzle 340 that could be used in place of the tortuous nozzle 310 in the diverter sub 322 of FIG. 29. The angled nozzle 340 preferably comprises a body 345 with a port 311 for accepting a pin (not shown) to connect the nozzle 340 to a flow sleeve 361 or another component. A flowbore 343 extends through the body 345 and comprises a conical inlet section 342, an orifice section 341, a straight dissipating section 344, and an exit end 346. As shown in FIG. 44, the inlet section 342 angles upwardly, while the orifice section 341 and the dissipating section 344 slope downwardly to the exit end 346. The dissipating section 344 is preferably straight with a substantially constant height 347, as shown in FIG. 44, and a preferably widening internal diameter 349 between orifice section 341 and the exit end 346, as shown in FIG. 45. The angled nozzle 340 is provided to dissipate pressure and may be provided alone or in combination with other components.

Figure 47:
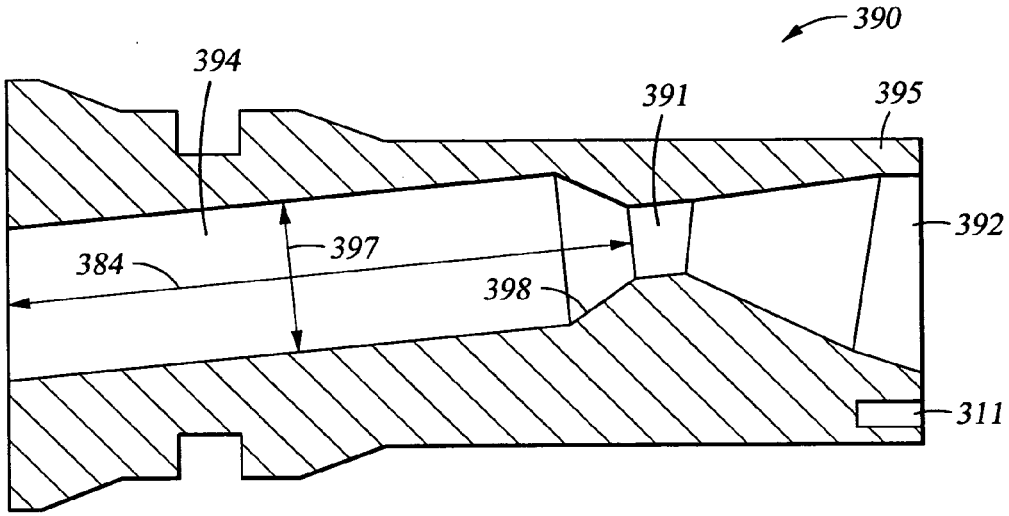
FIG. 47 is a cross-sectional side view of an alternative angled nozzle.
Figure 48:
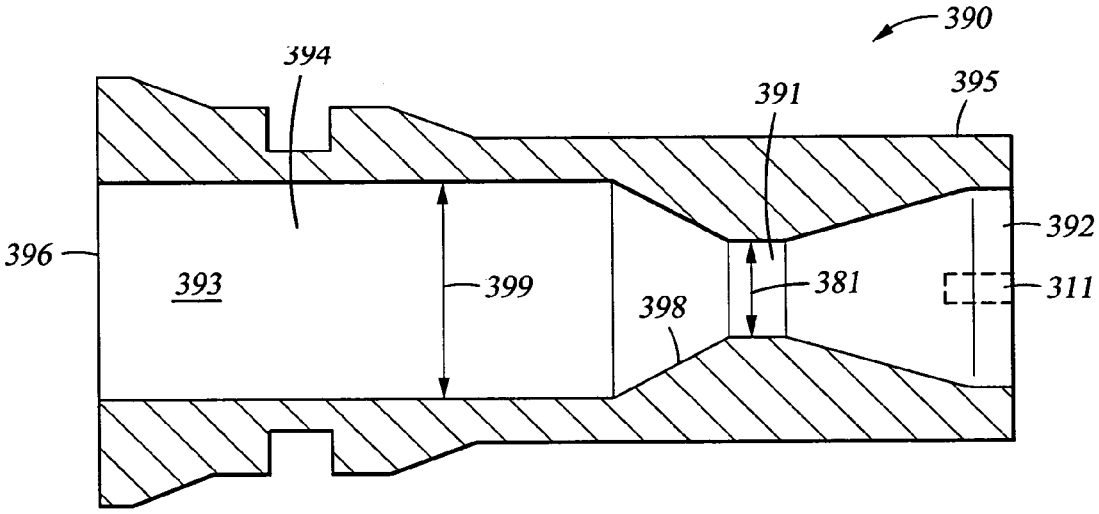
FIG. 48 is a cross-sectional top view of the alternative angled nozzle of FIG. 47.

In still another configuration, FIG. 47 and FIG. 48 depict an enlarged cross-sectional side view and an enlarged cross-sectional top view, respectively, of an alternative angled nozzle 390 that could be used in place of the tortuous nozzle 310 in the diverter sub 322 of FIG. 29. The alternative angled nozzle 390 preferably comprises a body 395 with a port 311 for accepting a pin (not shown) to connect the nozzle 390 to a flow sleeve 361 or another component. A flowbore 393 extends through the body 395 and comprises a conical inlet section 392, an orifice section 391 having a minimum width 381, a straight dissipating section 394, and an exit end 396. As shown in FIG. 47, the inlet section 392 angles upwardly, while the orifice section 391 and the dissipating section 394 slope downwardly to the exit end 396. The dissipating section 394 has a length 384 and preferably includes a shoulder 398 that meets the orifice section 391 at a sharp angle, such as a 60° angle. In one embodiment, the exit angle is 60° or greater to maximize the pressure loss and energy dissipation through the nozzle 390, and preferably the exit angle is 180°. The dissipating section 394 expands from the shoulder 398 to a straight section having a substantially constant height 397, as shown in FIG. 47. The dissipating section 394 further includes a substantially constant width 399, as shown in FIG. 48.

The alternative angled nozzle 390 of FIG. 47 and FIG. 48 is provided to dissipate pressure and may be provided alone or in combination with other components. To achieve eddy current effects that reduce pressure around the center of the flow as it moves through the nozzle 390, the height 397 and the width 399 of the dissipating section 394 each preferably range between 1.25 and 3 times greater than the minimum width 381 of the orifice section 391. Further, to achieve eddy currents that cause the diverted flow to dissipate into a relatively constant velocity profile, the length 384 of the dissipating section 394 is preferably at least equal to the width 399 of the dissipating section 394, and more preferably, the length 384 is greater than the width 399 of the dissipating section 394.

Referring now to FIG. 29, the tortuous nozzles 310, 330, 340 and 390 may be held in position with respect to the housing 220 in a variety of different ways, such as via a snap ring 363 for example. Alternatively, the tortuous nozzles 310, 330, 340, and 390 may threadingly connect to the housing 220, or may be disposed within a retaining sleeve (not shown) that threadingly connects to the housing 220. If a threaded connection is made, the snap ring 363 may provide a secondary attaching means.

As one of ordinary skill in the art will readily appreciate, a variety of methods may be employed to form the tortuous nozzle 310, the curved nozzle 330, the angled nozzle 340, and/or the alternative angled nozzle 390. One method is to use a mold material, such as glass or sand, for example, that enables application of a spray-on hard metal to the outside surface of the material that will form the body 315, 335, 345, 395. In particular, a tungsten carbide spray is may be applied in sufficient quantity to the outside surface of a mold material that will form the body 315, 335, 345, 395 of the tortuous nozzle 310, the curved nozzle 330, the angled nozzle 340, or the alternative angled nozzle 390, respectively. Once an adequate quantity of tungsten carbide is built up, the outside surface of the body 315, 335, 345, 395 is ground to the proper size and shape, and the flowbore 313, 333, 343, 393 of each nozzle 310, 330, 340, 390 is then formed, such as by melting the flowbore 313, 333, 343, 393 out. In this way, the tortuous nozzle 310,the curved nozzle 330, the angled nozzle 340, or the alternative angled nozzle 390 is provided with a tungsten carbide material to prevent excessive fluid erosion of the nozzle 310, 330, 340, 390 during operation.

Figure 4:
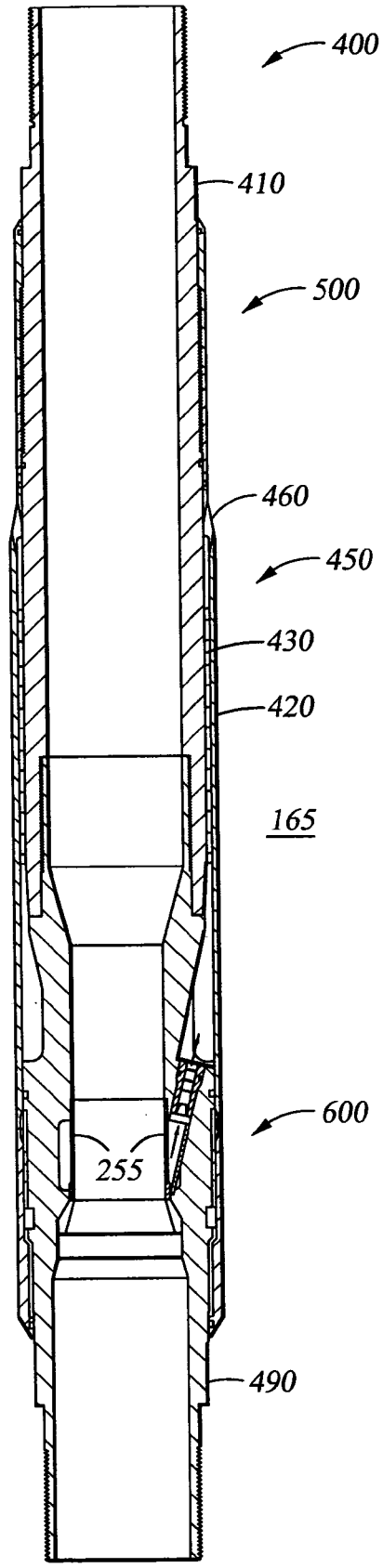
FIG. 4 is a cross-sectional schematic illustrating another embodiment of the present invention.

Referring now to FIG. 4, a cross-sectional view is provided for another embodiment of a diverter sub 400 comprising one or more diverter ports 255 and another embodiment of a diverter assembly 450. This embodiment of diverter assembly 450 includes an inner housing 410 fitting partially within an outer housing 420 to form a tortuous pathway 430 therebetween, as described in more detail below. A positioning assembly 500 may be provided at the upper end between the inner housing 410 and outer housing 420, and a flow adjusting assembly 600 may be provided at the lower end between the outer housing 420 and the lower section 490 of the diverter sub 400.

Figure 5:
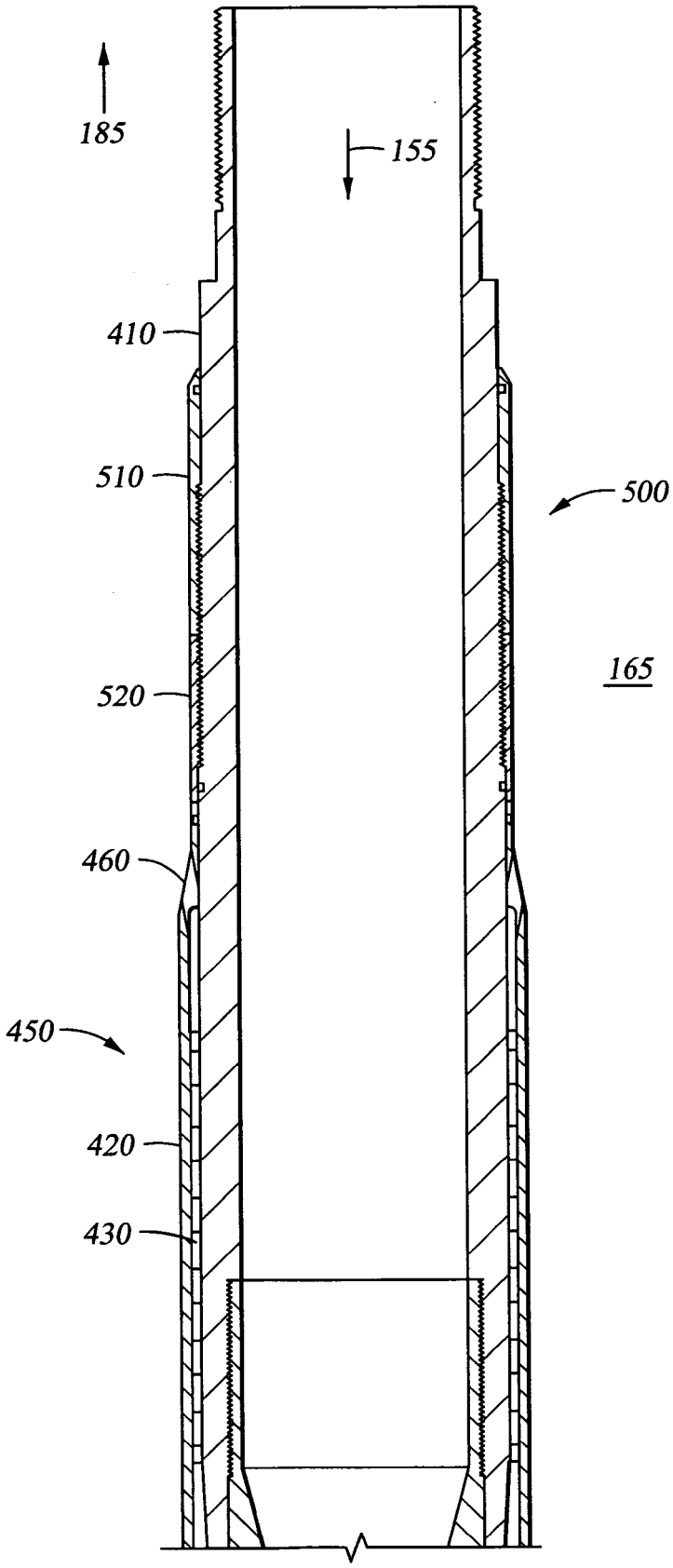
FIG. 5 is an enlarged view of the upper portion of the embodiment of FIG. 4.
Figure 6:
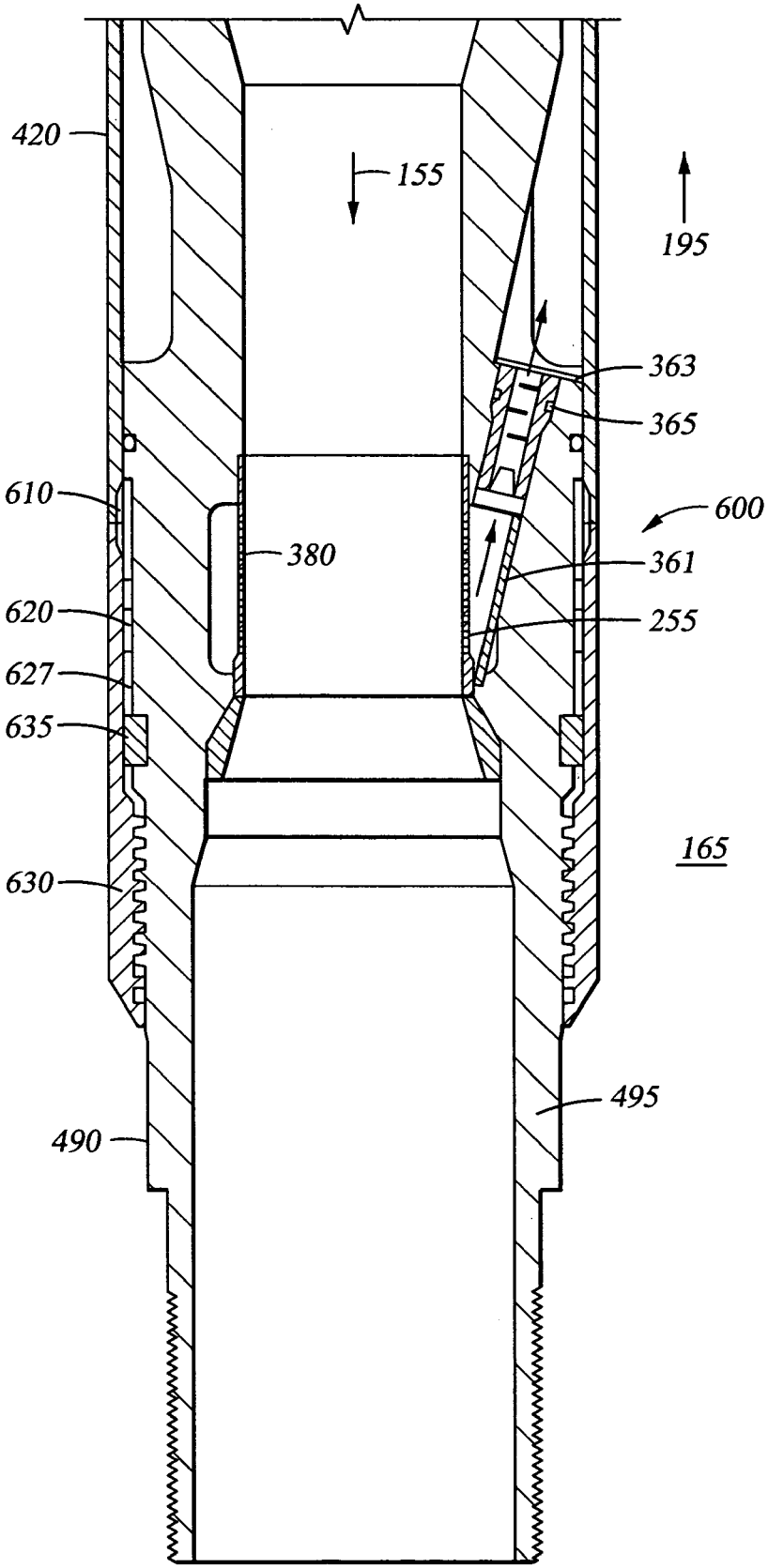
FIG. 6 is an enlarged view of the lower portion of the embodiment of FIG. 4.

FIG. 5 and FIG. 6 are enlarged views of the upper and lower portions of FIG. 4, respectively. As shown in FIG. 6, the diverter sub 400 includes one or more diverter ports 255 extending through the wall 495 of the lower section 490. One or more flow sleeves 361 may be provided that direct diverted drilling fluid through a threaded nozzle 365 and into the tortuous pathway 430, as shown in FIG. 5. The threaded nozzle 365 and the flow sleeve 361 may be held in position with respect to the lower section 490 in a variety of different ways, such as via threading into the housing and utilizing a snap ring 363 as a secondary attaching means as shown in FIG. 6. Alternatively, the nozzle 365 may be disposed within a retaining sleeve (not shown) that threadingly connects to the housing 220. A screen 380 may also be provided that extends across each diverter port 255 to prevent solid particles of a particular size from entering the flow sleeve 361. The screen 380 includes holes only large enough to allow solid particles therethrough that will not become lodged in the tortuous pathway 430. The screen 380 may be provided, for example, with a large number of 0.06 inch or smaller diameter holes such that particles greater than 0.06 inches in diameter will be prevented from entering the flow sleeve 361. The parallel cross-flow 155 through the diverter sub 400, and particularly through the lower section 490, acts to keep the screen 380 clear of solid particles that could prevent flow therethrough.

Referring to FIG. 5, the dissipating assembly 450 comprises a tortuous pathway 430 for the drilling fluid to traverse before exiting into the wellbore annulus 165 through one or more exit ports 460. In more detail, this dissipating assembly 450 comprises an inner housing 410 that fits partially within an outer housing 420 to form a tortuous pathway 430 therebetween.

Figure 34:
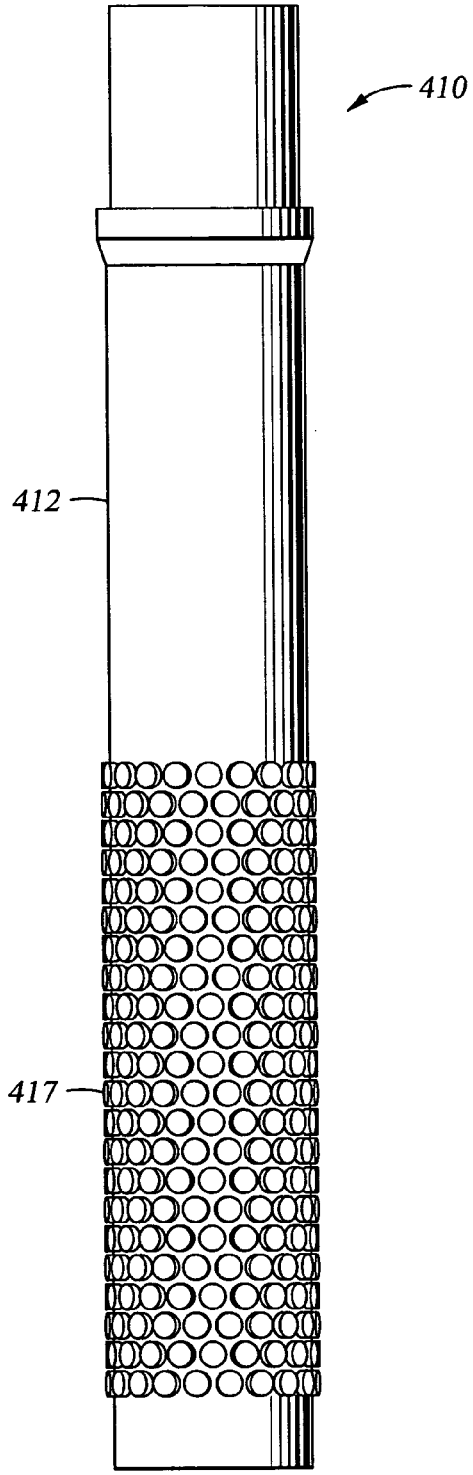
FIG. 34 depicts one configuration of the inner housing of the embodiment of FIG. 4, the inner housing having evenly-spaced, external circular protrusions.
Figure 35:
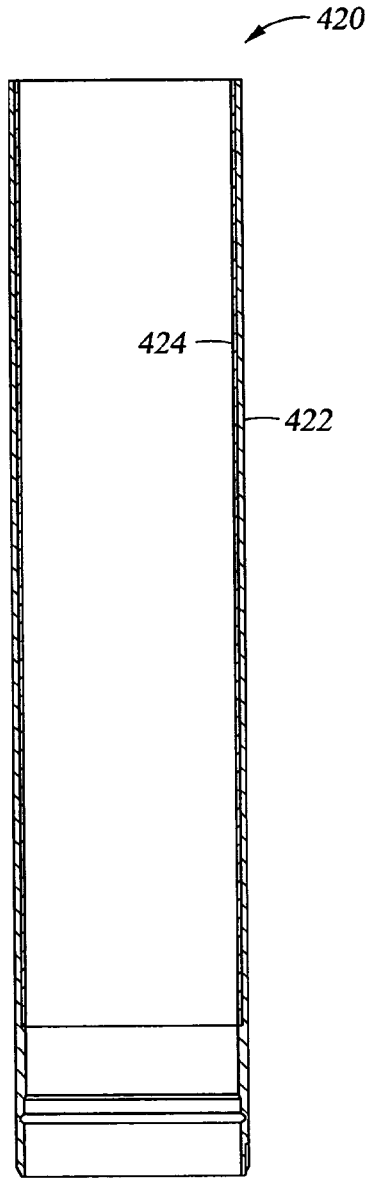
FIG. 35 depicts one configuration of the outer housing of the embodiment of FIG. 4, the outer housing having a smooth inner sleeve.
Figure 46:
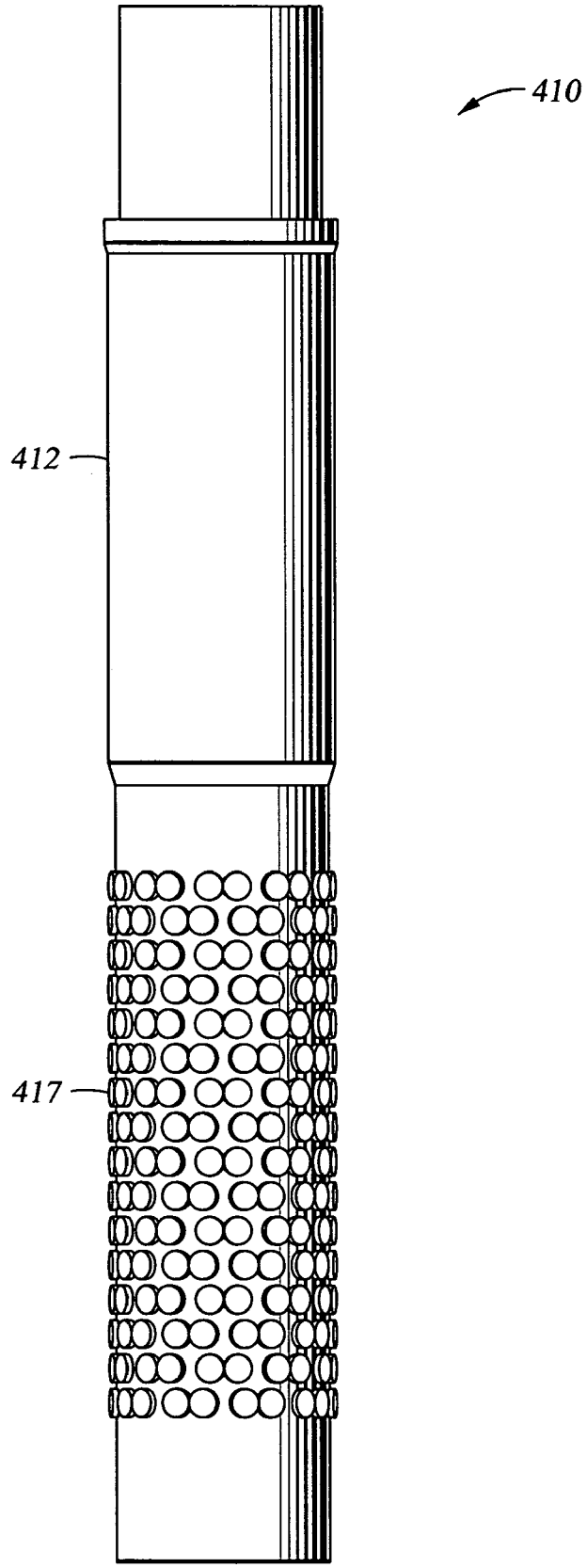
FIG. 46 depicts one configuration of the inner housing of the embodiment of FIG. 4, the inner housing having pairs of adjacent external circular protrusions with space between the pairs.

Different configurations of the inner housing 410 and the outer housing 420 are depicted in FIGS. 7, 8, 9, 34, 35, 36, 37, and 46. In one configuration of the inner housing 410 shown in FIG. 7, the tortuous pathway 430 is provided by a pattern of diamond-shaped protrusions 415 extending radially outwardly from the wall 412 of the inner housing 410 to engage a smooth inner sleeve 424 of the outer housing 420 as shown in FIG. 35. FIG. 34 depicts an alternate embodiment of this configuration, where the inner housing 410 has evenly-spaced circular protrusions 417 instead of the diamond-shaped protrusions 415 of FIG. 7. FIG. 46 depicts yet another embodiment of inner housing 410 with an arrangement of circular protrusions 417 that are provided in adjacent pairs with space between the pairs.

Figure 8:
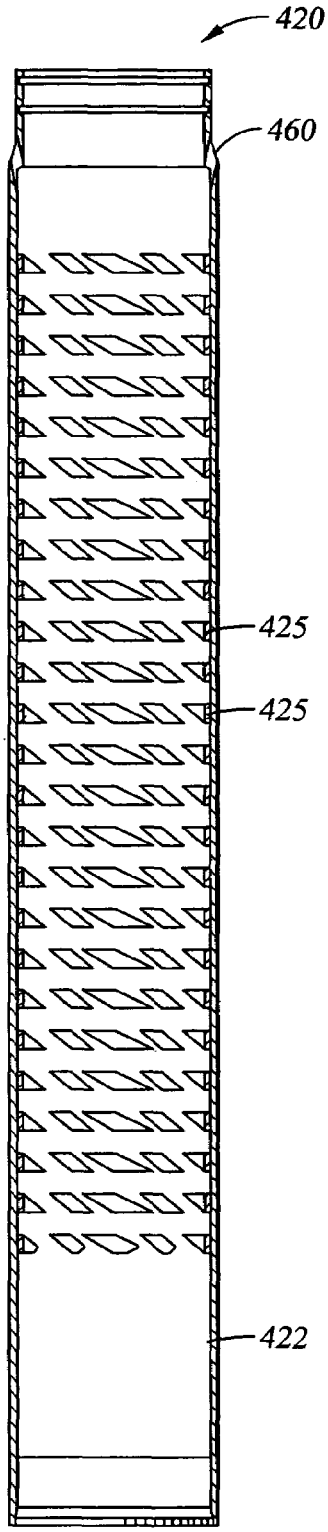
FIG. 8 depicts one configuration of the outer housing of the embodiment of FIG. 4, the outer housing having internal diamond-shaped protrusions.
Figure 37:
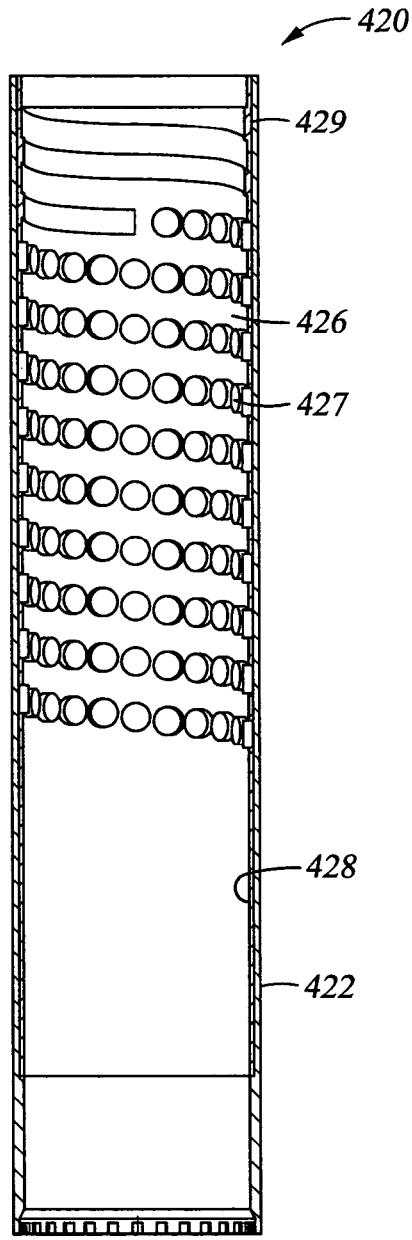
FIG. 37 depicts one configuration of the outer housing of the embodiment of FIG. 4, the outer housing having spiraling internal circular protrusions with space therebetween.

In one configuration of the outer housing 420 shown in FIG. 8, the tortuous pathway 430 is provided by a pattern of diamond-shaped protrusions 425 extending radially inwardly from the wall 422 of the outer housing 420 to engage a smooth wall (not shown) of the inner housing 410. FIG. 37 depicts an alternate embodiment of this configuration, where the outer housing 420 has spiraling circular protrusions 427 instead of the diamond-shaped protrusions 425 of FIG. 8.

Figure 9:
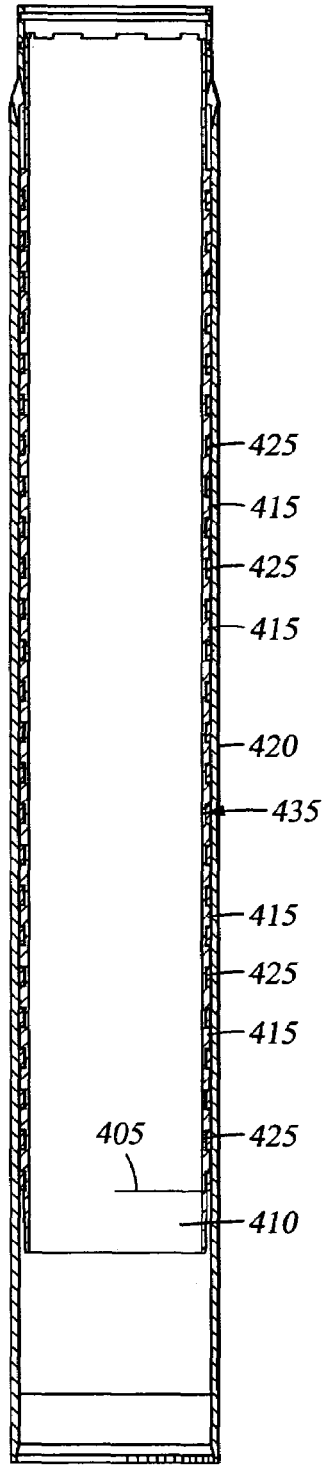
FIG. 9 is a cross-sectional elevation view of one configuration of the embodiment of FIG. 4, illustrating a tortuous pathway formed of intermeshed diamond-shaped protrusions that extend between inner and outer housings.
Figure 36:
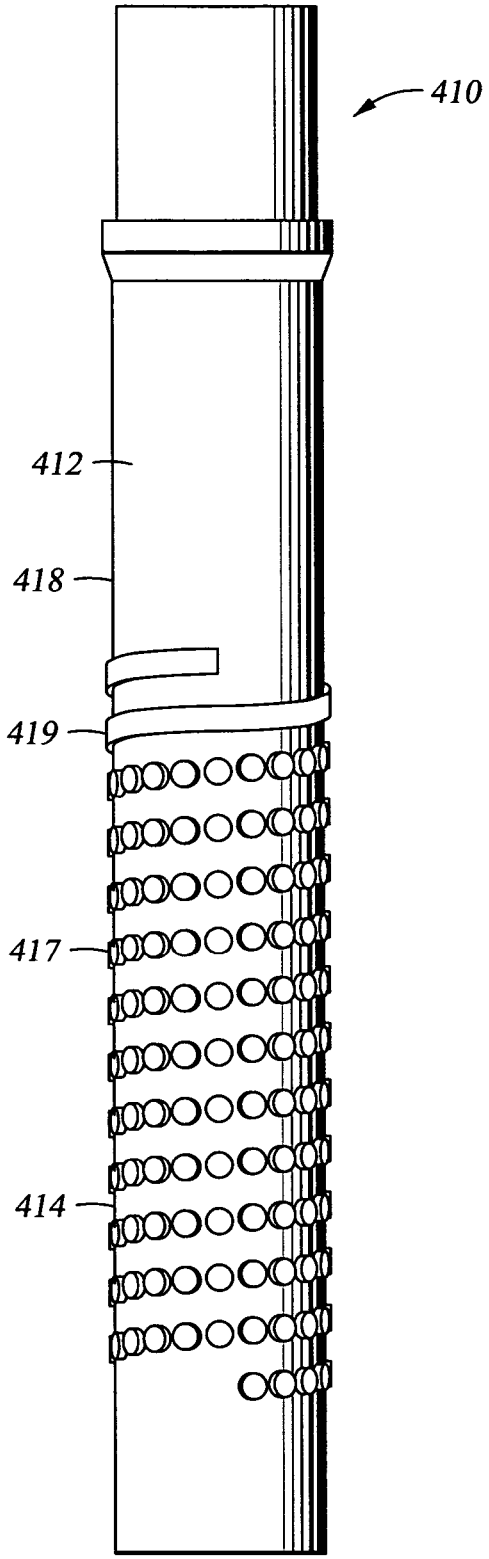
FIG. 36 depicts one configuration of the inner housing of the embodiment of FIG. 4, the inner housing having spiraling external circular protrusions with space therebetween.

In yet another configuration as shown in FIG. 9, the tortuous pathway 430 is provided as an intermeshed pattern 435 of protrusions formed by threading together the diamond-shaped protrusions 415, 425 extending from the walls 412, 422 of both the inner housing 410 and the outer housing 420, the intermeshed pattern 435 creating an adjustable tortuous pathway 430 to allow more or less flow therethrough. In an alternate embodiment of this configuration, FIG. 36 depicts inner housing 410 having spiraling external circular protrusions 417 with space 414 therebetween, and FIG. 37 depicts outer housing 420 having spiraling internal circular protrusions 427 with space 426 therebetween. Thus, the inner housing 410 and outer housing 420 may be threaded together to create an intermeshed pattern 435 of circular protrusions 417, 427 that provides an adjustable tortuous pathway 430 to allow more or less flow therethrough. Although diamond-shaped protrusions 415, 425 and circular protrusions 417, 427 have been depicted and described, the protrusions may be provided as a pattern of squares, rectangles, triangles, or any other shape, such as bullet-shaped, for example, that obstructs the flow path.

Thus, patterns of protrusions of various configurations create tortuous pathways 430 caused by obstructions that restrict the flow such that pressure is dissipated as the drilling fluid traverses the area between the housings 410, 420. The protrusions restrict the flow because the drilling fluid must flow around the protrusions and into the spaces therebetween. Thus, relatively high pressure diverted drilling fluid enters the tortuous pathway 430 and lower pressure drilling fluid flows into the wellbore annulus 165 through the exit ports 460, preferably at a velocity of less than 80 feet per second.

In the configurations of FIGS. 7, 8, 34, 35, and 46 where protrusions 415, 417 are provided on the inner housing 410 or protrusions 425, 427 are provided on the outer housing 420 but not both, a specific pressure drop is achieved as the drilling fluid traverses the tortuous pathway 430, but the flow rate is not adjustable through the tortuous pathway 430. In these configurations, the flow rate is adjustable by changing the size of the nozzles 305, such as, for example, nozzle 310, 330, 340, or 390, that may be disposed in the diverter ports 255. Further, the particular arrangement of the protrusions 415, 417 effects how much pressure dissipation is realized as diverted fluid flows through the tortuous pathway 430. For example, the adjacent pairs of circular protrusions 417 shown in FIG. 46 provide more pressure dissipation than the evenly-spaced arrangement shown in FIG. 34 because the adjacent pairs of protrusions 417 cause more dramatic changes in flow direction and fluid momentum, thereby resulting in greater pressure drop.

In the configuration of FIGS. 9, 36 and 37 with an intermeshed pattern of protrusions 435, the flow rate is adjusted at the surface simply by rotating one housing, preferably the outer housing 420, with respect to the other housing, preferably the inner housing 410, thereby changing the size of the open flow space through the tortuous pathway 430.

Figure 10:
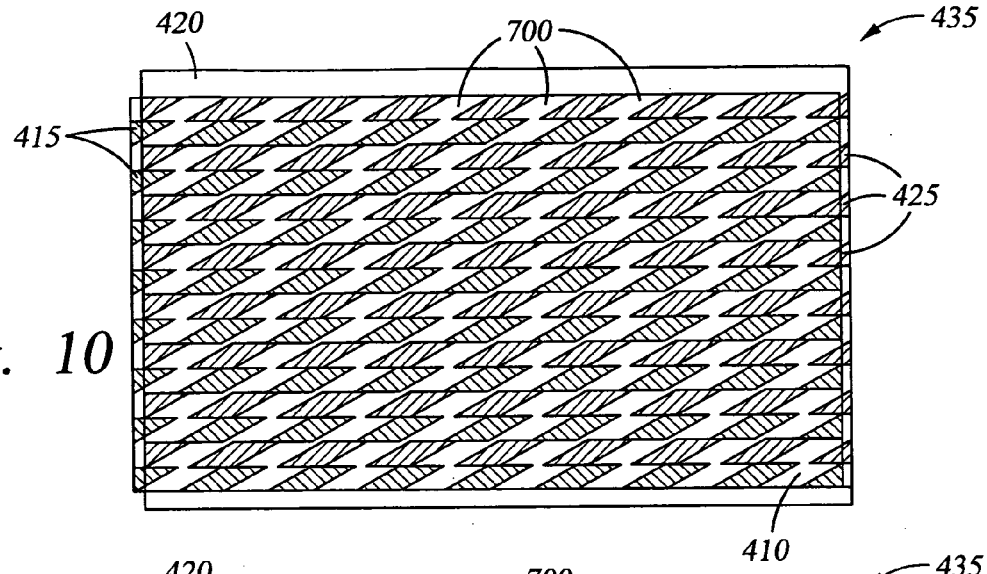
FIG. 10 illustrates the most constricted position of the adjustable flow area through the tortuous pathway of FIG. 9.
Figure 11:
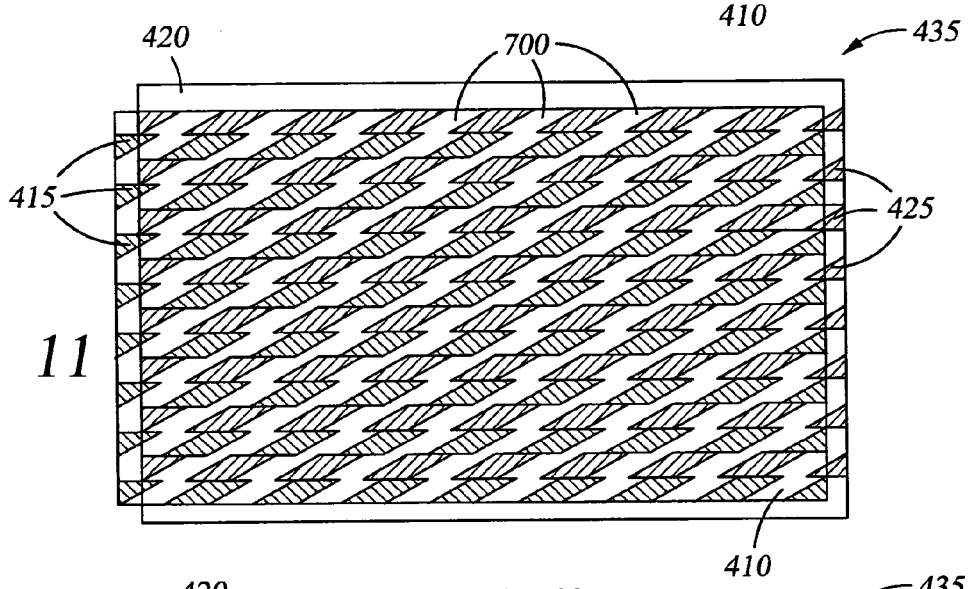
FIG. 11 illustrates a partially constricted position of the adjustable flow area through the tortuous pathway of FIG. 9.
Figure 12:
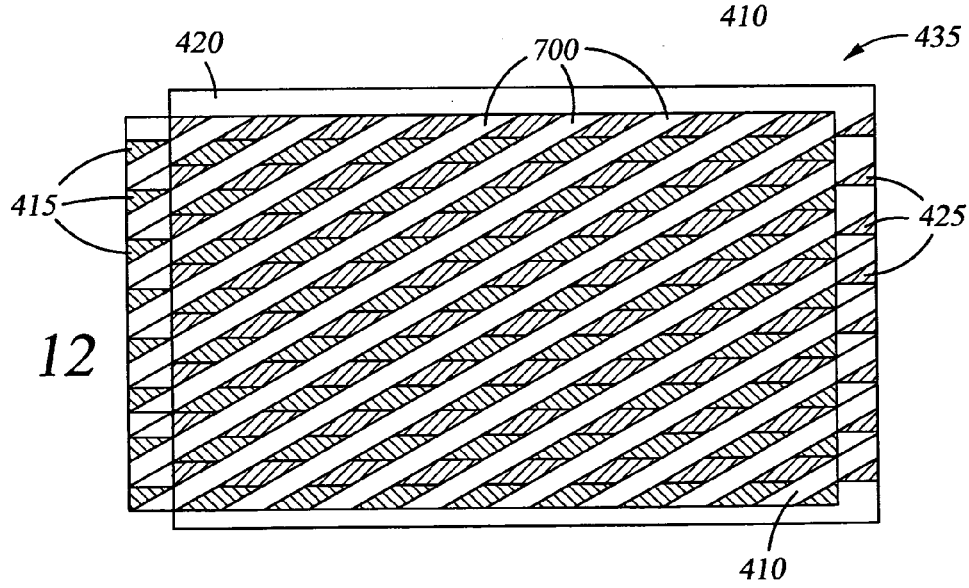
FIG. 12 illustrates the most open position of the adjustable flow area through the tortuous pathway of FIG. 9.

FIGS. 10, 11, and 12 depict various levels of constriction of the adjustable intermeshed pattern 435 formed of diamond-shaped protrusions 415, 425. FIG. 10 depicts the protrusions 415, 425 in the position that most constricts the open flow areas 700 therebetween. However, even with the protrusions 415, 425 positioned as shown in FIG. 10, some drilling fluid is still able to flow through the intermeshed pattern 435. FIG. 11 depicts the protrusions 415, 425 in a position that provides more open flow area 700 than in FIG. 10, and FIG. 12 depicts the protrusions 415, 425 in the position that provides the most open flow area 700 through the intermeshed pattern 435.

Figure 38:
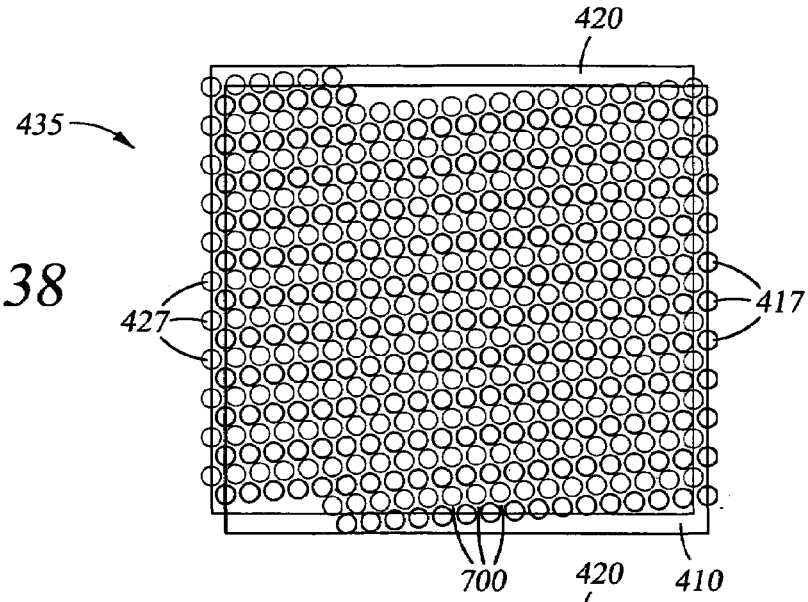
FIG. 38 illustrates the most constricted position of the adjustable flow area through a tortuous pathway of intermeshed circular protrusions.
Figure 39:
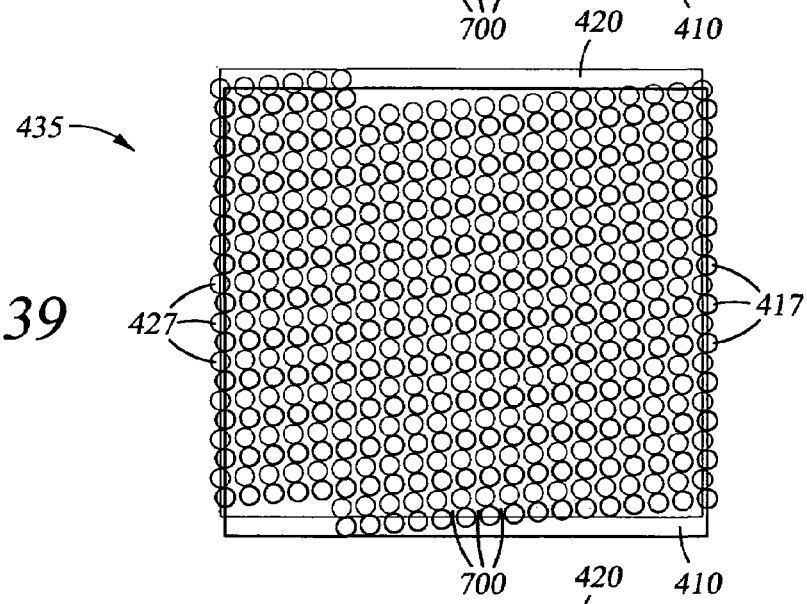
FIG. 39 illustrates a partially constricted position of the adjustable flow area through a tortuous pathway of intermeshed circular protrusions.
Figure 40:
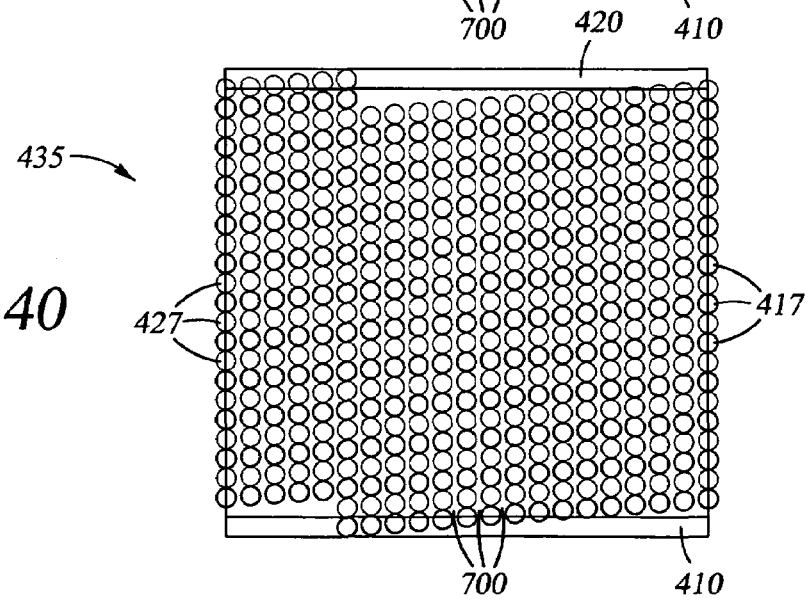
FIG. 40 illustrates the most open position of the adjustable flow area through a tortuous pathway of intermeshed circular protrusions.

Similarly, FIGS. 38, 39 and 40 depict various levels of constriction of the adjustable intermeshed pattern 435 formed of circular protrusions 417, 427. FIG. 38 depicts the protrusions 417, 427 in the position that most constricts the open flow areas 700 therebetween. FIG. 39 depicts the protrusions 417, 427 in a position that provides more open flow area 700 than in FIG. 38, and FIG. 40 depicts the protrusions 417, 427 in the position that provides the most open flow area 700 through the intermeshed pattern 435.

Figure 41:
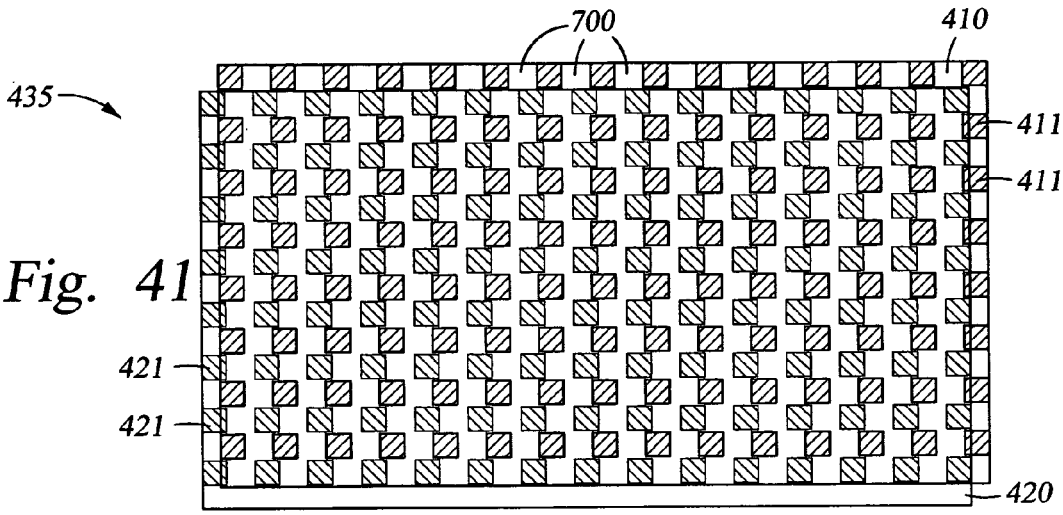
FIG. 41 illustrates the most constricted position of the adjustable flow area through a tortuous pathway of intermeshed square-shaped protrusions.
Figure 42:
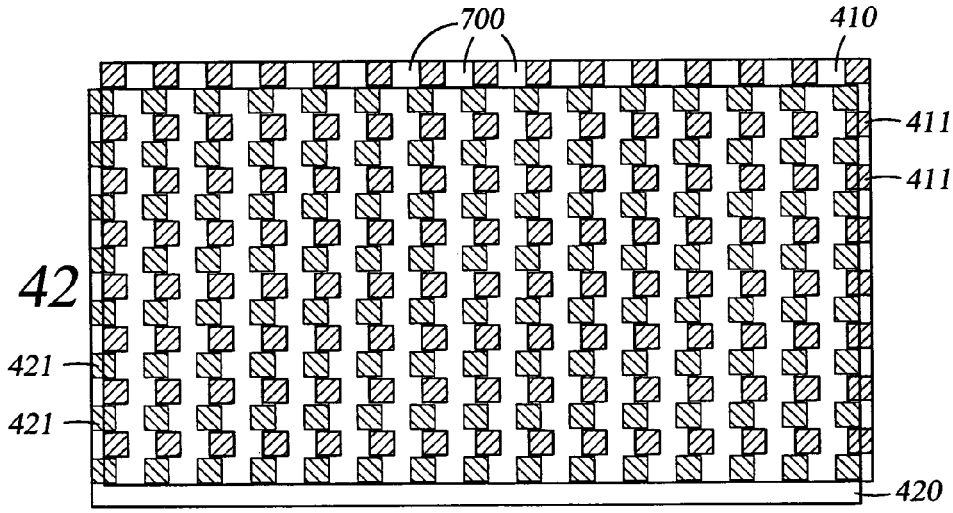
FIG. 42 illustrates a partially constricted position of the adjustable flow area through a tortuous pathway of intermeshed square-shaped protrusions.
Figure 43:
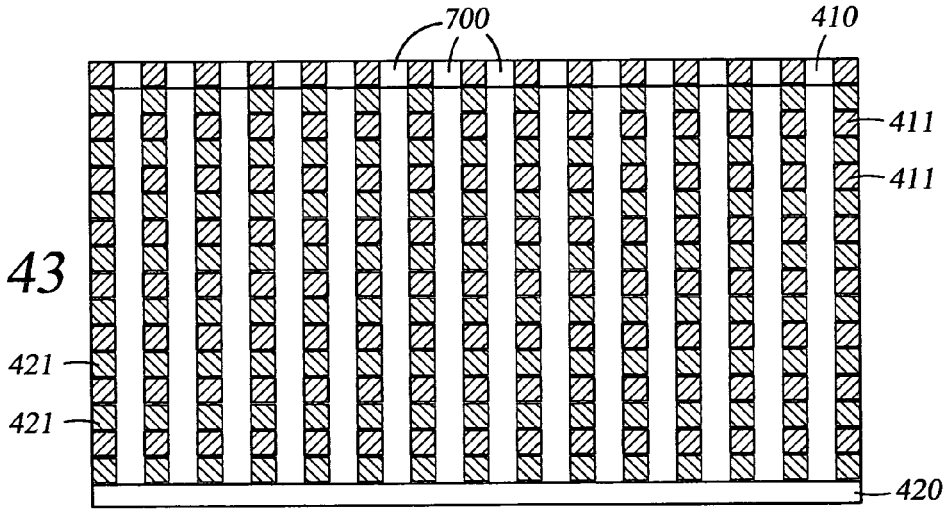
FIG. 43 illustrates the most open position of the adjustable flow area through a tortuous pathway of intermeshed square-shaped protrusions.

As stated previously, the protrusions may be provided as a pattern of squares, rectangles, triangles, or any other shape that obstructs the flow path. FIGS. 41, 42, and 43 provide an example of various levels of constriction of an intermeshed pattern 435 formed of square protrusions 411, 421. FIG. 41 depicts the protrusions 411, 421 in the position that most constricts the open flow areas 700 therebetween. FIG. 42 depicts the protrusions 411, 421 in a position that provides more open flow area 700 than in FIG. 41, and FIG. 43 depicts the protrusions 411, 421 in the position that provides the most open flow area 700 through the intermeshed pattern 435. As one of ordinary skill in the art will appreciate, the square protrusions 411, 421 would not thread together. Instead, the outer housing 420 slips onto the inner housing 410 and is positioned axially such that the square protrusions 411 of the inner housing 410 fit between the square protrusions 421 of the outer housing 420. Once the inner housing 410 and outer housing 420 are axially aligned, the outer housing 420 could then be rotated with respect to the inner housing 410 to adjust the flow area 700 between the square protrusions 411, 421.

To prevent erosion, the protrusions are preferably formed of a hard material, such as tungsten carbide, regardless of their shape. For example, the circular protrusions 417, 427 of FIG. 34, FIG. 36 and FIG. 37 may be tungsten carbide inserts disposed through the wall 412, 422 of the inner housing 410 and the outer housing 420, respectively. Alternatively, the protrusions may be formed of steel that is coated with a hard material, such as tungsten carbide. It is also preferable for the flow sleeves 361, the nozzles 305, 310, 330, 340, 390 and the housings 410, 420 to be formed of tungsten carbide, or alternatively, to be formed of steel coated with a spray-on hard metal, such as tungsten carbide. For example, the inner housing 410 of FIG. 36 may include a spray-on hard metal coating 418 on the outer surface of the wall 412, and the outer housing 420 of FIG. 37 may include a spray-on hard metal coating 428 on the inner surface of the wall 422. Alternatively, as shown in FIG. 35, a hard metal sleeve 424 may be provided within the outer wall 422 of the outer housing 420.

The manufacturing costs associated with forming the protrusions may impact the selected pattern, and diamond-shaped protrusions 415, 425 are easily formed using a gear machine. For example, to form the intermeshed pattern of diamond-shaped protrusions shown in FIG. 9, a gear machine turns each of the housings 410, 420 in one direction to create a first pattern, and then cuts circumferential grooves across the first pattern of each housing 410, 420, thereby creating diamond-shaped protrusions 415, 425. For the configurations of FIGS. 7 and 8 where diamond-shaped protrusions are provided on either the inner housing 410 or the outer housing 420 but not both, as an alternative to cutting circumferential grooves across a first pattern, the gear machine may turn the housing 410, 420 in the opposite direction to cross the first pattern with a second pattern.

In one embodiment, a multi-lead thread and circumferential grooves are cut into the outer housing 420 to produce diamond shaped protrusions 425. Likewise, the same number multi-lead thread is cut into the inner housing 410 along with circumferential grooves to produce diamond-shaped protrusions 415. The multi-lead thread may have up to twelve leads, and, for example, may include eight leads for a drilling assembly with an outer diameter of 3⅛ inches. To assemble the inner housing 410 into the outer housing 420 of the dissipating assembly 450 as shown in FIG. 9, the multi-lead threads of each housing 410, 420 are aligned to thread the inner housing 410 into the outer housing 420. Once the threading is complete and the protrusions 415, 425 form the intermeshed pattern 435, the outer housing 420 can be rotated with respect to the inner housing 410 without moving axially. By rotating the outer housing 420, the size of the open space 700 through the tortuous pathway 430 changes, as shown in FIGS. 10–12, thereby adjusting the flow rate and the pressure dissipation that can be achieved.

Figure 13:
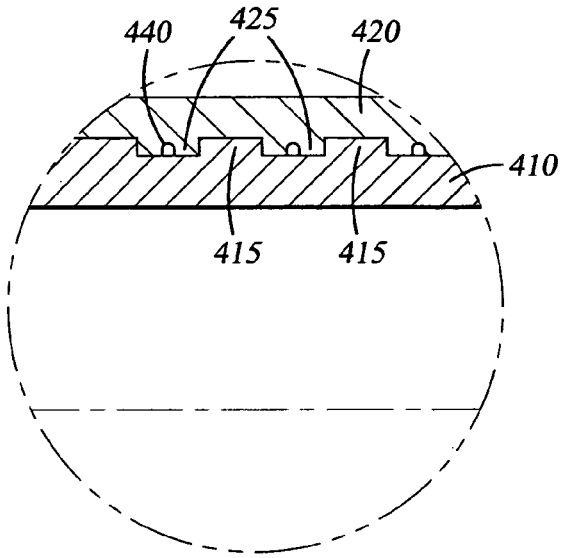
FIG. 13 is a cross-sectional view of the interconnected protrusions of the inner and outer housings of FIG. 9, showing a channel through the crest of one set of protrusions.

As shown in FIG. 13, to prevent solids in the drilling fluid from becoming lodged in the intermeshed pattern 435 of diamond-shaped protrusions 415, 425, a channel 440 may be provided on the crest of at least one set of protrusions, such as protrusions 425, that ensures an open pathway for particles of a particular size. Thus, any particle that passes through the screen 380 has an open channel 440 to traverse, even if the flow area 700 through the tortuous pathway 430 is at its most constricted position as shown in FIG. 10. Channels 440 may be provided on the outer housing protrusions 425, as shown in FIG. 13, or on the inner housing protrusions 415, or both. These channels 440 traverse the length of each protrusion, and their shape is such that a solid of a particular size can pass through the channel 440, such as, for example, a solid having a 0.06 inch diameter.

In the alternate embodiment of FIG. 36 and FIG. 37, the intermeshed pattern 435 of circular protrusions 417, 427 is created by slipping the outer housing 420 onto the inner housing 410 until the outer housing threads 429 align with the inner housing threads 419. The inner housing 410 is then threaded into the outer housing 420, and the threads 419, 429 align the protrusions 417, 427 to enable rotation of the outer housing 420 with respect to the inner housing 410. This rotation changes the size of the open space 700 through the tortuous pathway 430, as shown in FIGS. 38–40, thereby adjusting the diverted flow rate and the pressure dissipation that can be achieved. The threads 419 of the inner housing 410 are preferably slotted, and the threads of the outer housing 420 are preferably shallow to enable cross-flow and allow solid particles of a particular size to pass through.

Referring again to FIGS. 4, 5 and 6, diverter sub 400 includes two additional assemblies 500, 600 for use with the configuration of FIG. 9 or FIGS. 36–37 having an intermeshed pattern of protrusions 435. Positioning assembly 500 and flow adjusting assembly 600 are provided at the upper end and at the lower end of diverter sub 400, respectively. In the configuration of FIG. 9, the functions of the positioning assembly 500 are to maintain axial alignment between the inner housing 410 and outer housing 420 in a fully-threaded position, enable rotation of the outer housing 420 with respect to the inner housing 410 without significant axial movement, and reduce or eliminate axial loading on the protrusions. In the alternate configuration of FIGS. 36–37, the positioning assembly 500 enables rotation of the outer housing 420 with respect to the inner housing 410, and then the shoulder of the outer housing 420 is locked into position to reduce or eliminate axial loading on the protrusions.

The function of the flow adjusting assembly 600 is to enable adjustment of the flow area 700 through the tortuous pathway 430 and then to lock the desired position for operation. The details of one embodiment of the positioning assembly 500 and one embodiment of the flow adjusting assembly 600 are described herein. However, as one of ordinary skill in the art will readily appreciate, a variety of alternate embodiments may be provided to perform the functions required of the positioning assembly 500 and the flow adjusting assembly 600.

Figure 7:
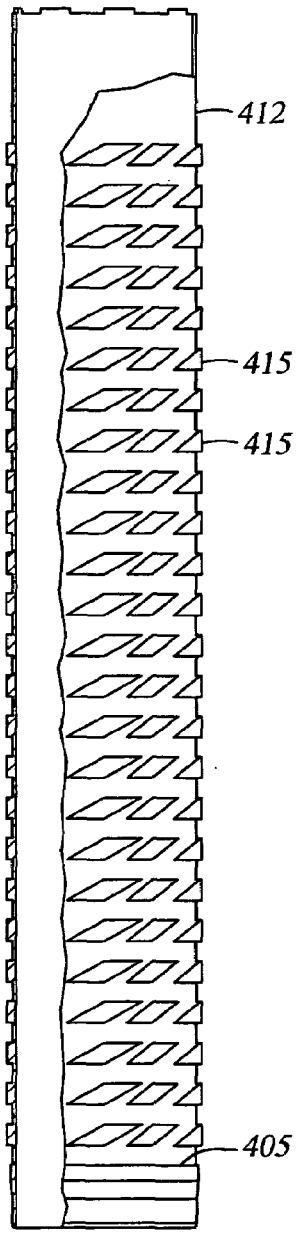
FIG. 7 depicts one configuration of the inner housing of the embodiment of FIG. 4, the inner housing having external diamond-shaped protrusions.

Referring now to FIG. 5, the positioning assembly 500 comprises an axial positioning sub 520 and a locking sub 510. In general, the axial positioning sub 520 fixes the axial location of the outer housing 420 with respect to the inner housing 410 and enables the outer housing 420 to rotate freely. The locking sub 510 secures the axial positioning sub 520 in place. In more detail, when assembling the inner housing 410 within the outer housing 420, it is important for the preferably diamond-shaped protrusions 415, 425 to be properly positioned so that they interlock. Further, the outer housing 420 must be capable of rotational movement with respect to the inner housing 410 without interference to adjust the flow area 700 through the tortuous pathway 430. Therefore, as shown in FIG. 7, the inner housing 410 includes a shoulder 405 at its lower end against which the lowermost row of diamond-shaped protrusions 425 from the outer housing 420 rests when the two housings 410, 420 are interconnected, as shown in FIG. 9. This shoulder 405 establishes the axial positioning between the inner and outer housings 410, 420. The axial positioning sub 520 is designed to maintain this position and enable rotation of the outer housing 420 with respect to the inner housing 410 without rotating the lower section 490 of the diverter sub 400.

Figure 14:
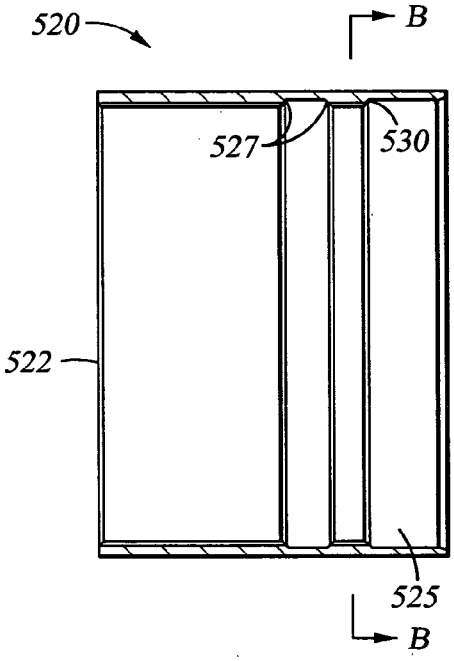
FIG. 14 is a cross-sectional side view of one configuration of an axial positioning sub of the embodiment of FIG. 4.
Figure 15:
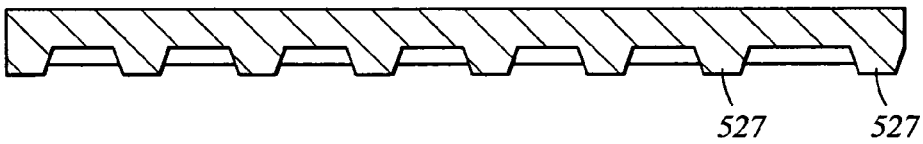
FIG. 15 depicts a thread detail of the axial positioning sub of FIG. 14.
Figure 18:
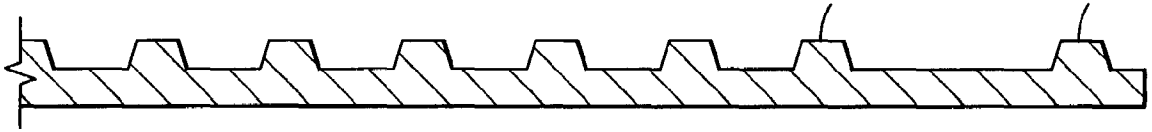
FIG. 18 depicts a thread detail of the inner housing of FIG. 17.

Referring now to FIGS. 5, 14, 15, and 18, after positioning the inner housing 410 and outer housing 420 axially utilizing shoulder 405, the axial positioning sub 520 is threaded into position against the outer housing 420 as shown in FIG. 5. FIG. 14 depicts an enlarged, cross-sectional side view of the disconnected axial positioning sub 520 having an upper end 522 and an internally threaded lower end 525. The lower threaded end 525 threads onto the outer housing 420. The lower end 525 also preferably includes an internal special thread 527, as shown in detail in FIG. 15, for connecting to an external special thread 535 of the inner housing 410, as shown in FIG. 18. Thus, the axial positioning sub 520 mates with the inner housing 410 via the special threading arrangement 527, 535, thereby connecting the outer housing 420 to the inner housing 410. As shown in FIGS. 15 and 18, the threads 527, 535 are preferably designed to be approximately 60% of the width of a typical thread to provide a gap between threads 527, 535. Thus, the special threads 527, 535 provide an axial clearance to allow the axial positioning sub 520 to move axially by as much ⅓ of the thread pitch without rotating.

Figure 16:
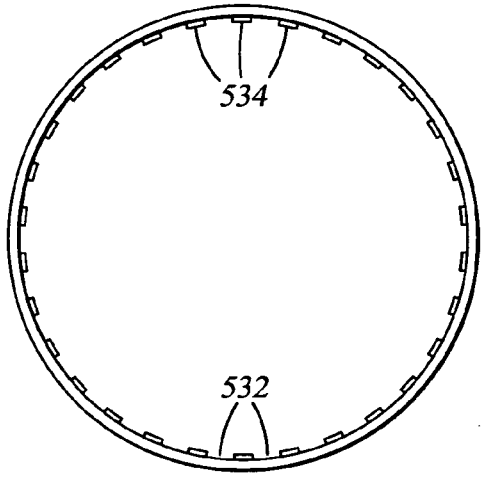
FIG. 16 is a cross-sectional view of plane B—B of the axial positioning sub of FIG. 14.
Figure 19:
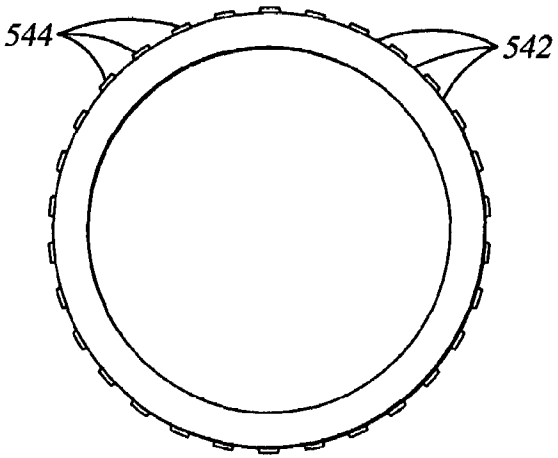
FIG. 19 is a cross-sectional view of plane A—A of the inner housing of FIG. 17.
Figure 17:
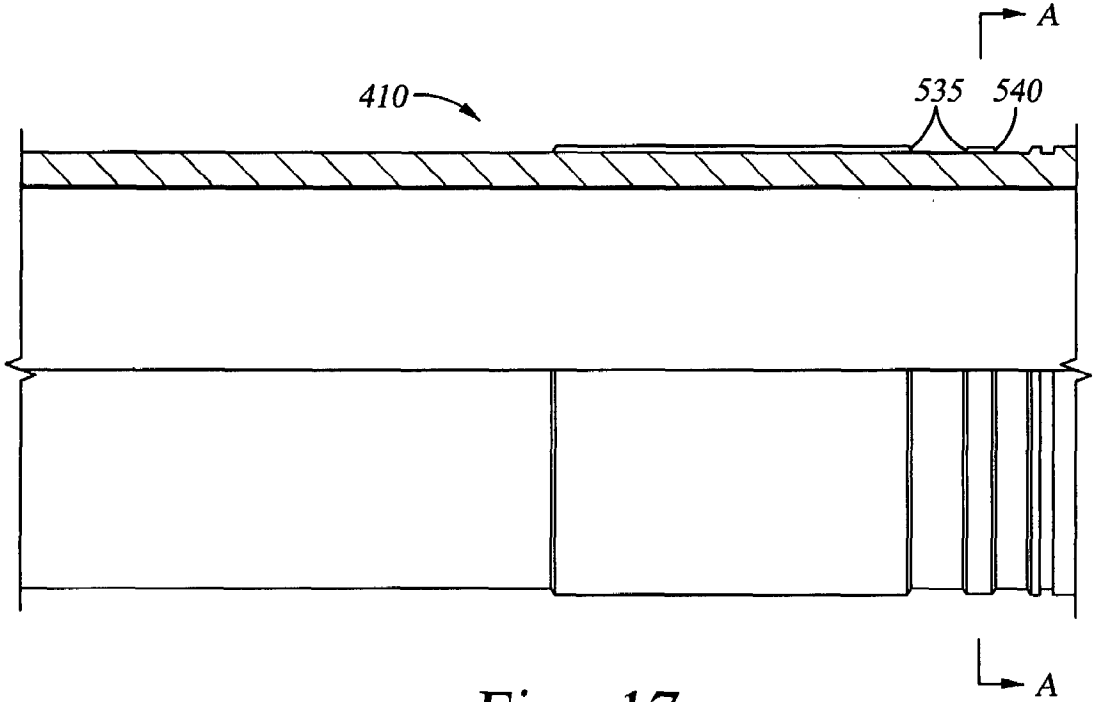
FIG. 17 is a side view, partially in cross-section, of one configuration of an inner housing of the embodiment of FIG. 4.

FIG. 16 depicts a cross-section of the axial positioning sub 520 of FIG. 14 taken at line B—B. This cross-section depicts another internal feature of the axial positioning sub 520. Namely, an internal thread extension 530 with slots 532 cut into the thread form 530, thereby creating a number of equally spaced internal teeth 534, such as thirty teeth, for example. FIG. 19 depicts a cross-section of the inner housing 410 of FIG. 17 taken at line A—A, which shows a matching external thread extension 540 with slots 542 cut into the thread form 540, thereby creating a number of equally spaced external teeth 544 for mating with the teeth 534 of the axial positioning sub 520. The thread extensions 530, 540 of the axial positioning sub 520 and inner housing 410 preferably have their lead offset by an extra ⅓ pitch from the rest of the threaded connection 527, 535.

Thus, to connect the axial positioning sub 520 to the inner housing 410, the axial positioning sub 520 is rotated into place via the special threads 527, 535. Once threaded into position, the axial positioning sub 520 is pushed down to interlock the internal teeth 534 of the axial positioning sub 520 with the external teeth 544 of the inner housing 410. In this position, the outer housing 420 is capable of substantially free rotation about the inner housing 410 without substantial axial movement, and preferably axial movement of less than 0.03 inches. The locking sub 510 can then be installed.

Figure 20:
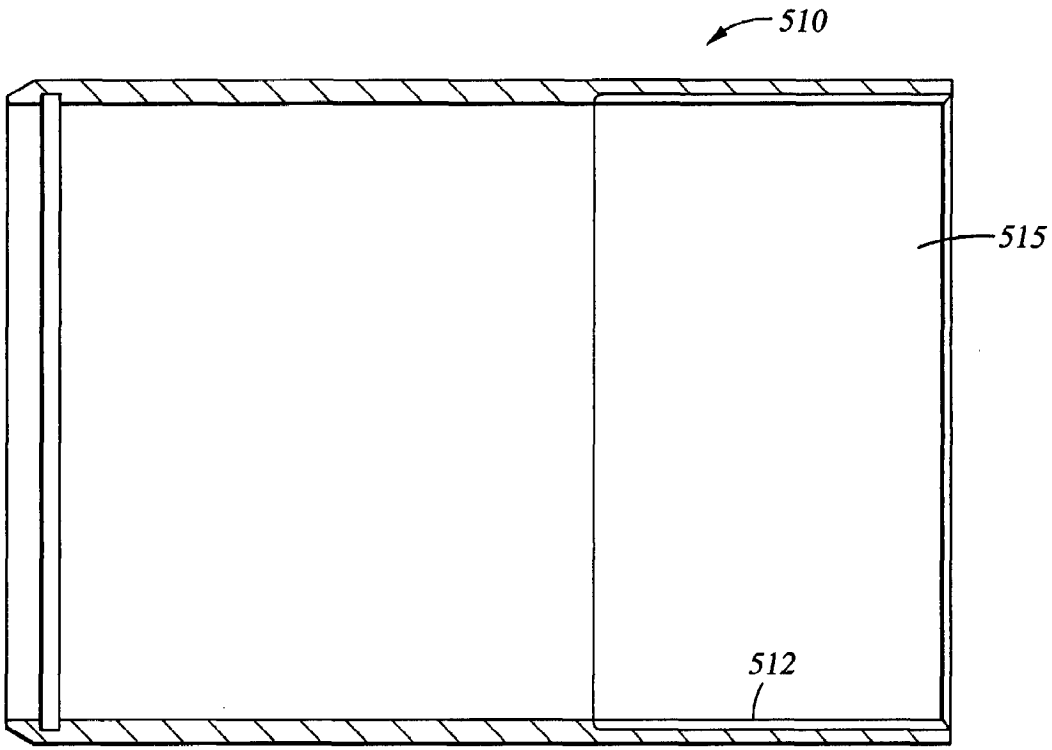
FIG. 20 is a cross-sectional side view of one configuration of a locking sub of the embodiment of FIG. 4.
Figure 21:
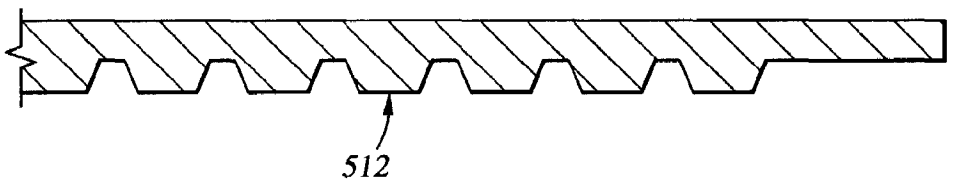
FIG. 21 depicts a thread detail of the locking sub of FIG. 20.

As shown in FIG. 20, the locking sub 510 includes an internally threaded lower end 515. The internal threads 512 at the lower end 515 of the locking sub 510, shown in detail in FIG. 21, engage matching external threads (not shown) on the inner housing 410, enabling the locking sub 510 to lock against the inner housing 410. The locking sub 510 is threaded down until the lower threaded end 515 receives the upper shoulder 522 of the axial positioning sub 520. Then the locking sub 510 is tightened to the torque required to secure the positioning assembly 500 in place for drilling.

Referring now to FIG. 4 and FIG. 6, once the inner housing 410 and outer housing 420 are assembled axially utilizing the axial positioning assembly 500, the flow area 700 through the tortuous assembly 430 may be set by the flow adjusting assembly 600 disposed at the lower end of the diverter sub 400. The flow adjusting assembly 600 includes an adjusting housing 630, an upper adjusting sleeve 610, and a lower adjusting sleeve 620.

Figure 22:
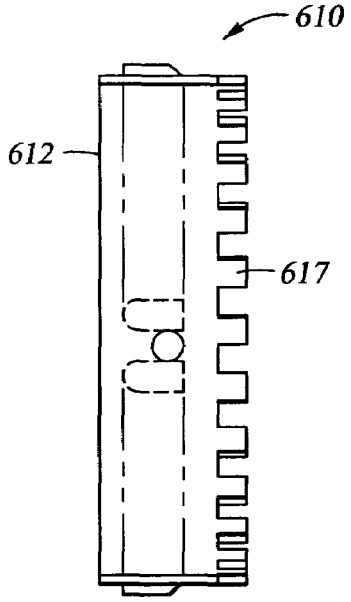
FIG. 22 is a cross-sectional side view of one configuration of an upper adjusting sleeve of the embodiment of FIG. 4.
Figure 23:
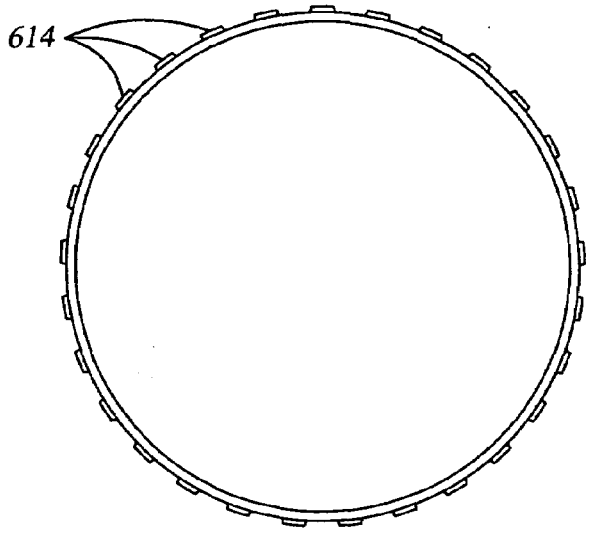
FIG. 23 depicts a top cross-sectional view of the upper adjusting sleeve of FIG. 22.
Figure 24:
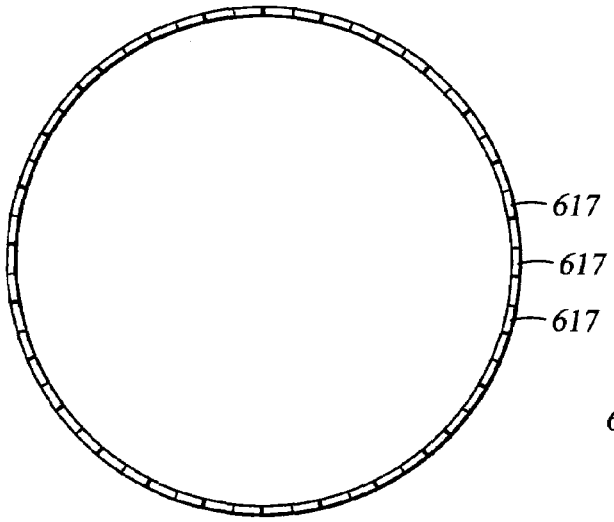
FIG. 24 depicts a bottom cross-sectional view of the upper adjusting sleeve of FIG. 22.
Figure 25:
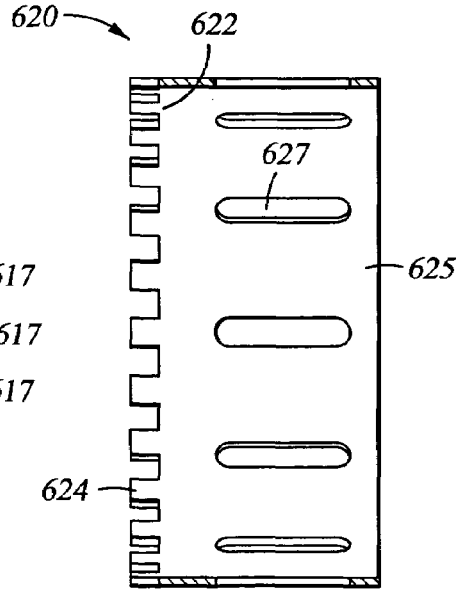
FIG. 25 is a cross-sectional side view of one configuration of a lower adjusting sleeve of the embodiment of FIG. 4.
Figure 26:
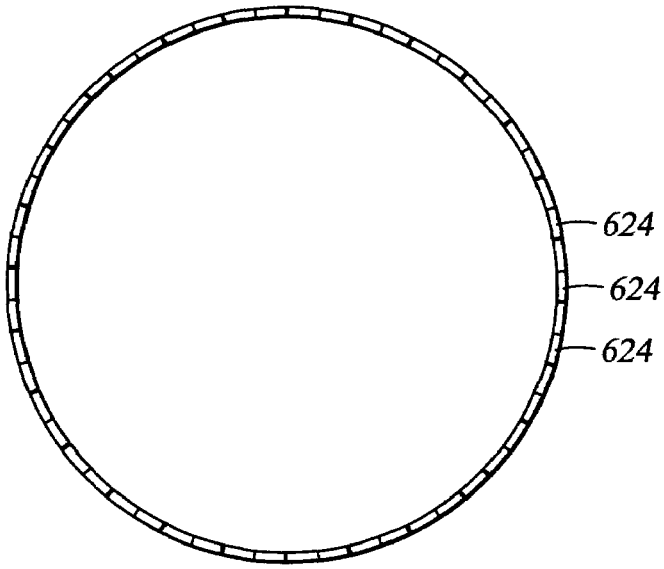
FIG. 26 depicts a top cross-sectional view of the lower adjusting sleeve of FIG. 25.

FIGS. 22, 23, and 24 depict a cross-sectional side view, a cross-sectional top view, and a cross-sectional bottom view of the upper adjusting sleeve 610, respectively. The upper adjusting sleeve 610 preferably includes equally spaced, radially outwardly extending splines 614 at the upper end 612 and equally spaced, axially extending dogs 617 at the lower end 615. FIG. 25 and FIG. 26 depict a cross-sectional side view and a cross-sectional top view of the lower adjusting sleeve 620, respectively. The lower adjusting sleeve 620 preferably includes equally spaced, axially extending dogs 624 at the upper end 622, and equally spaced, axially extending slots 627 disposed around its circumference along the lower end 625. The slots 627 are designed to accept one or more keys 635, shown in FIG. 6, that extend radially inwardly from the adjusting housing 630.

Figure 27:
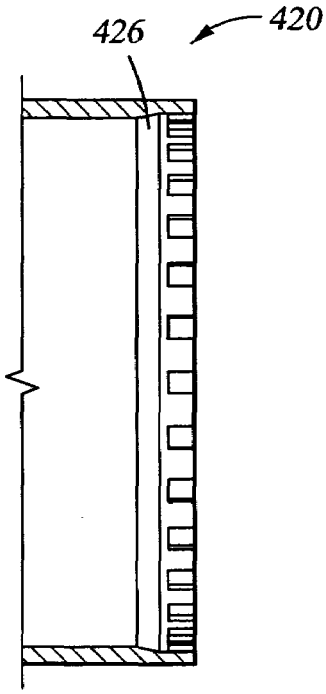
FIG. 27 is a partial cross-sectional view of the one configuration of an outer housing of the embodiment of FIG. 4.
Figure 28:
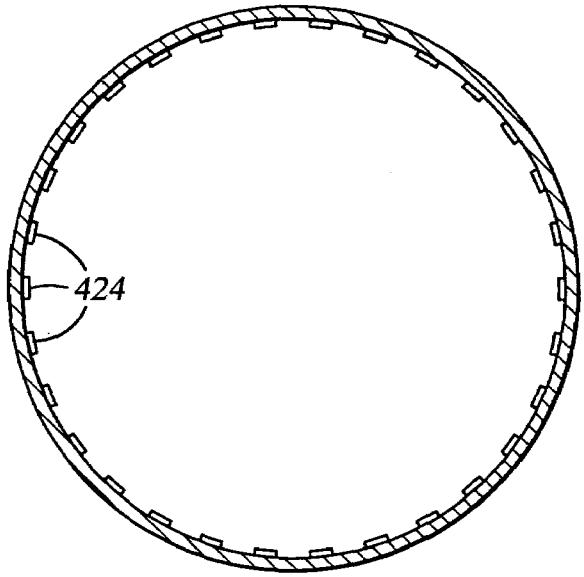
FIG. 28 depicts an end view of the outer housing of FIG. 27.

FIG. 27 and FIG. 28 depict a cross-sectional side view and a cross-sectional bottom view of the outer housing 420, respectively. The lower end 426 of the outer housing 420 includes splines 424 that extend radially inwardly, and are designed to interconnect with the radially outwardly extending splines 614 of the upper adjusting sleeve 610 shown in FIG. 23.

The upper adjusting sleeve 610 and the lower adjusting sleeve 620 connect via dogs 617, 624 that extend axially from each sleeve 610, 620. The connected splines 424, 614 between the outer housing 420 and the upper sleeve 610 along with the connected dogs 617, 624 between the upper sleeve 610 and lower sleeve 620 allow for a measured change in the flow area 700 of the tortuous pathway 430 resulting from rotation of the outer housing 420 with respect to the inner housing 410. The number of dogs 617, 624 is preferably different than the number of splines 424, 614 connecting the upper sleeve 610 to the outer housing 420, and more preferably, the number of dogs 617, 624 is one greater than the number of splines 424, 614. For example, the number of dogs 617, 624 extending from each sleeve 610, 620 is preferably thirty and the number of splines 424, 614 is preferably twenty-nine for a drilling assembly 200 with an outer diameter of 3⅛ inches.

Having a twenty-nine spline connection between the outer housing 420 and the upper adjusting sleeve 610 and a thirty dog connection between the upper and lower adjusting sleeves 610, 620 allows for very fine adjustments in the flow area 700 of the tortuous pathway 430. Namely, by providing one additional position with respect to the upper sleeve 610 and the lower sleeve 620, the possibilities of rotationally positioning the outer housing 420 are multiplied versus having the same number of splines 424, 614 and dogs 617, 624. A one-dog rotation of the upper sleeve 610 with respect to the lower sleeve 620 also rotates the spline connection of the upper sleeve 610 and outer housing 420 by 1/(29*30) of the circumference at the diameter of engagement with respect to the lower section 490. Accordingly, a one-dog adjustment of a drilling assembly 200 having an outer diameter of 3⅛ inches results in about ½ GPM change in flow rate through the tortuous pathway 430.

The slot 627 and key 635 arrangement of lower adjusting sleeve 620 and adjusting housing 630, respectively, enables the lower adjusting sleeve 620 to move axially, but prevents rotation of the lower adjusting sleeve 620 with respect to the adjusting housing 630. The adjusting housing 630 threads onto lower section 490 and shoulders against the lower end 426 of the outer housing 420 to lock the axial and rotational position of the assembly for drilling. Thus, the upper and lower adjusting sleeves 610, 620 position the outer housing 420 rotationally when all of the components are assembled, thereby fixing the flow area 700 through the tortuous pathway 430, and the adjusting housing 630 then locks the position of the outer housing 420.

To change the flow area 700 through the tortuous pathway 430, which changes the flow rate and pressure dissipation achieved, the outer housing 420 must be rotated with respect to the inner housing 410. To rotate the outer housing 420, first the adjusting housing 630 is unthreaded from the lower section 490 and moved downwardly from the outer housing 420. Then the lower adjusting sleeve 620 is moved downwardly to disconnect it from the upper adjusting sleeve 610. The upper sleeve 610 is then rotated with respect to the lower sleeve 620 by the number of dogs 617, 624 required to change the flow area 700 to allow a given GPM therethrough, and the outer housing 420 is rotated to match up with the spline 614, 624 connection between the outer housing 420 and the upper positioning sleeve 610. Calibrated marks are preferably provided on the outer surface of the lower section 490 and on the outer housing 420 at its lower internal splines 424. Each mark represents a given flow rate change. Once the rotation of the outer housing 420 is complete, the flow adjusting assembly 600 can be made up again, and the outer housing 420 is then locked in position by the adjusting housing 630.

In operation, the flow area 700 is set at the surface. The desired flow rate is predetermined by flow testing and/or calculations. Once attached to the working string at the rig, the drilling assembly 200 is lowered below the injectors 140 and the diverter sub 400, with dissipating assembly 450, are flow tested to determine if the actual diverted flow rate is within tolerance of the desired flow rate. Drilling fluid weights and viscosities impact flow properties so that differences in settings are required to achieve the same flow rate through the diverter sub 400. If the diverted flow along path 190 is not within the range of flow rates required for flow velocities to effectively carry cuttings 180 from the deviated wellbore 170, the diverter sub 400 is raised into the tower, and the flow adjusting assembly 600 is released to allow rotation of the outer housing 420 with respect to the inner housing 410. This rotation incrementally expands or reduces the flow area 700 through the tortuous pathway 430. Thus, the flow area 700 is adjustable at the rig floor without removing the diverter sub 400 from the drilling assembly 200 and without removing the drilling assembly 200 from the coiled tubing 150.

If necessary, the diverter ports 255 can also be plugged off so that no flow can pass therethrough. To plug off the diverter ports 255, the positioning assembly 500 is disconnected, thereby allowing the outer housing 420 to be unscrewed and lifted to expose the flow sleeves 360. Preferably the flow sleeves 361 are held in place by nozzles, such as nozzles 305, 310, 330, 340, 365 or 390. The nozzles can be replaced by a plug (not shown) to block flow.

Figure 49:
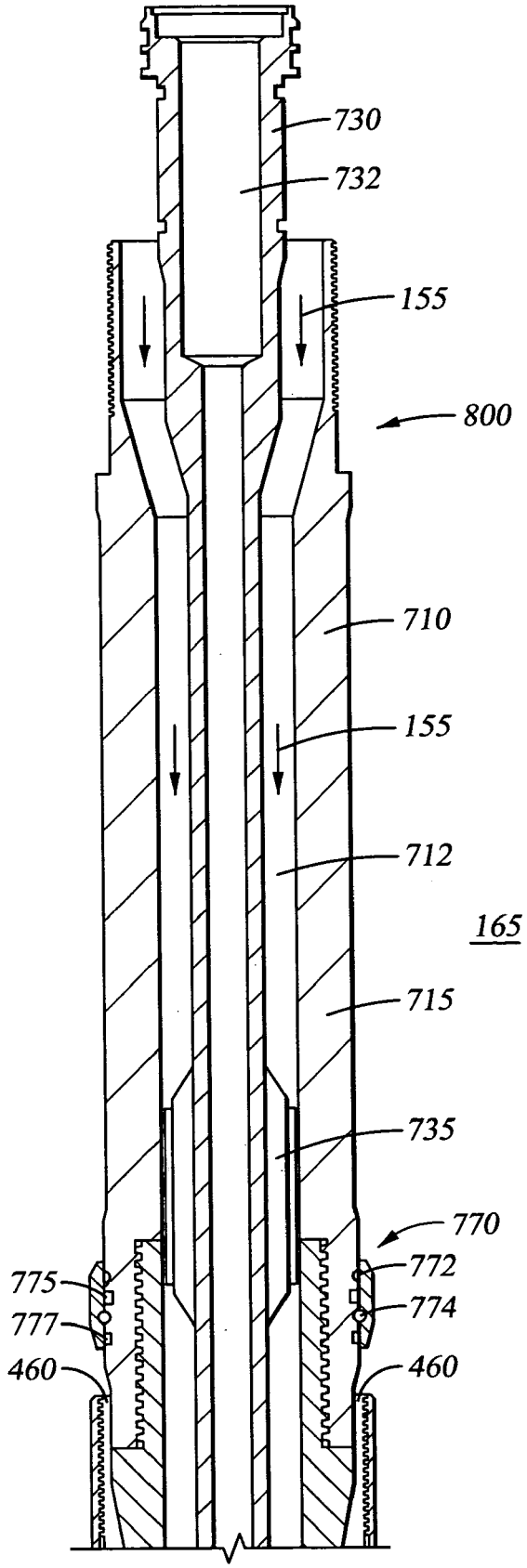
FIG. 49 is an enlarged, cross-sectional schematic of the upper portion of another embodiment of the present invention in the operational position.
Figure 50:
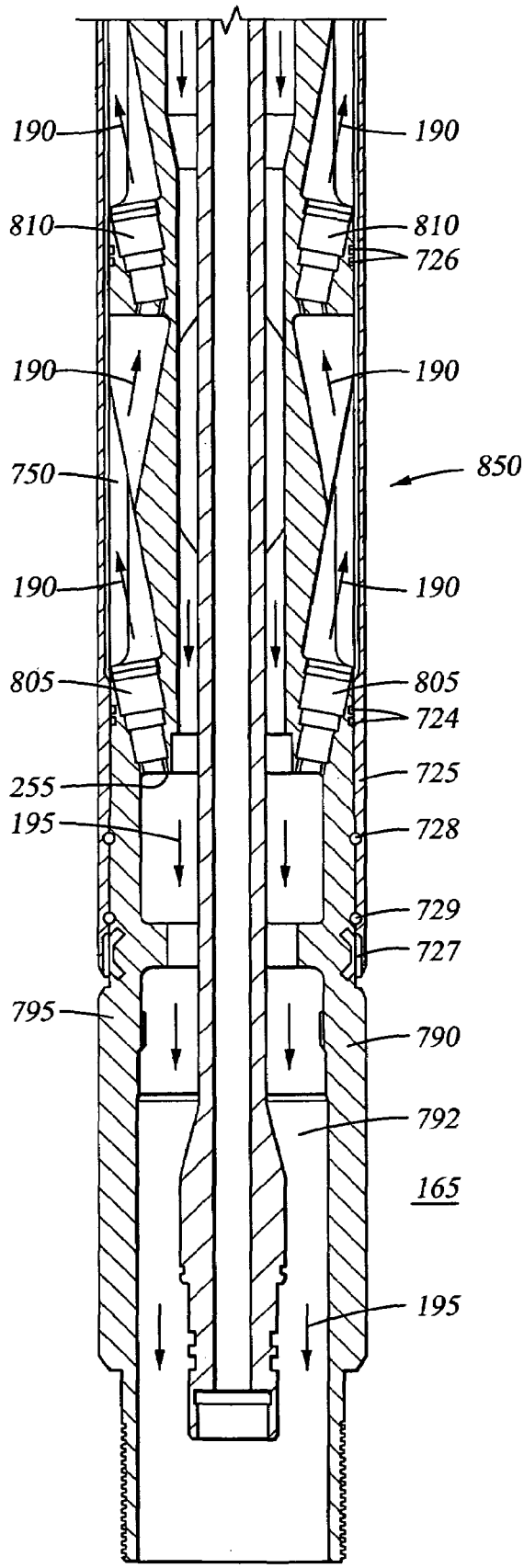
FIG. 50 is an enlarged, cross-sectional schematic of the lower portion of another embodiment of the present invention in the operational position.

FIGS. 49 and 50 provide enlarged, cross-sectional views of the upper and lower portions, respectively, of an alternate diverter sub 800 comprising an alternate dissipating assembly 850, and with diverter sub 800 in the operational position. The diverter sub 800 comprises an upper housing 710 defining a flow bore 712, a lower housing 790 defining a flow bore 792, a locating sleeve 770 disposed on the upper housing 710, and a barrier cylinder 725 disposed on the lower housing 790. An optional electronics housing 730 may also be provided, which includes a bore 732 for feeding electrical wires therethrough and stabilizer wings 735 to centralize the electronics housing 730 within the flow bores 712, 792 of the upper housing 710 and lower housing 790, respectively. As one of ordinary skill in the art will appreciate, the electronics housing 730 may be included in any of the previously described diverter subs.

As depicted in FIG. 49, seals 775, 777 and soft nail axial grooves 772, 774 are provided in the wall 715 upper housing 710 adjacent the locating sleeve 770. A soft nail is driven into groove 774 to provide a fixed connection between the locating sleeve 770 and the upper housing 710. As depicted in FIG. 50, seals 724, 726; soft nail axial grooves 728, 729; and a soft nail circumferential groove 727 are disposed in the wall 795 of the lower housing 790 adjacent the barrier cylinder 725. A soft nail is driven into groove 727 to provide a fixed connection between the barrier cylinder 725 and the lower housing 790.

FIG. 50 also depicts the dissipating assembly 850, which comprises multiple sets of nozzles 805, 810 for the diverted drilling fluid to traverse before exiting into the wellbore annulus 165 through one or more exit ports 460. In more detail, one or more diverter ports 255 extend through the wall 795 of the lower housing 790. A first set of nozzles 805 connect into the diverter ports 255 to direct diverted drilling fluid flowing along path 190 into a chamber 750 where the pressure drops, and then through a second set of nozzles 810 before exiting into the wellbore annulus 165 through ports 460 (depicted in FIG. 49). Thus, instead of directing diverted fluid through a single set of nozzles 305 and through baffles 370 or into a tortuous pathway 430 as previously described, this embodiment of dissipating assembly 850 utilizes multiple sets of nozzles 805, 810 in series to provide flow rate and pressure drop adjustability. In particular, the flow rate and pressure drop of the fluid diverted along path 190 may be controlled by flow nozzles 805, 810 that can be replaced at the surface. As one of ordinary skill in the art will appreciate, the diverter sub 800 is not limited to just two sets of nozzles 805, 810 in series. Further, the nozzles 805, 810 are not necessarily identical and may comprise a variety of different configurations, such as nozzle 305, 330, 340, or 390, for example.

Figure 51:
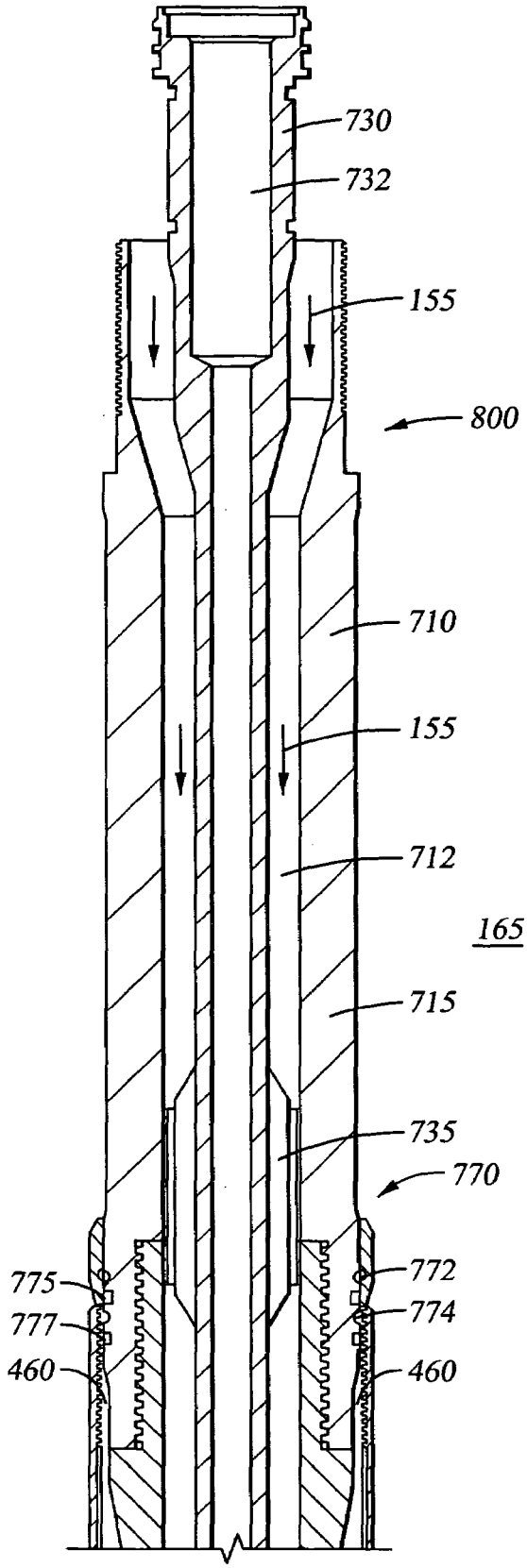
FIG. 51 is an enlarged, cross-sectional schematic of the upper portion of the embodiment of FIGS. 49 and 50 in the no-flow position.
Figure 52:
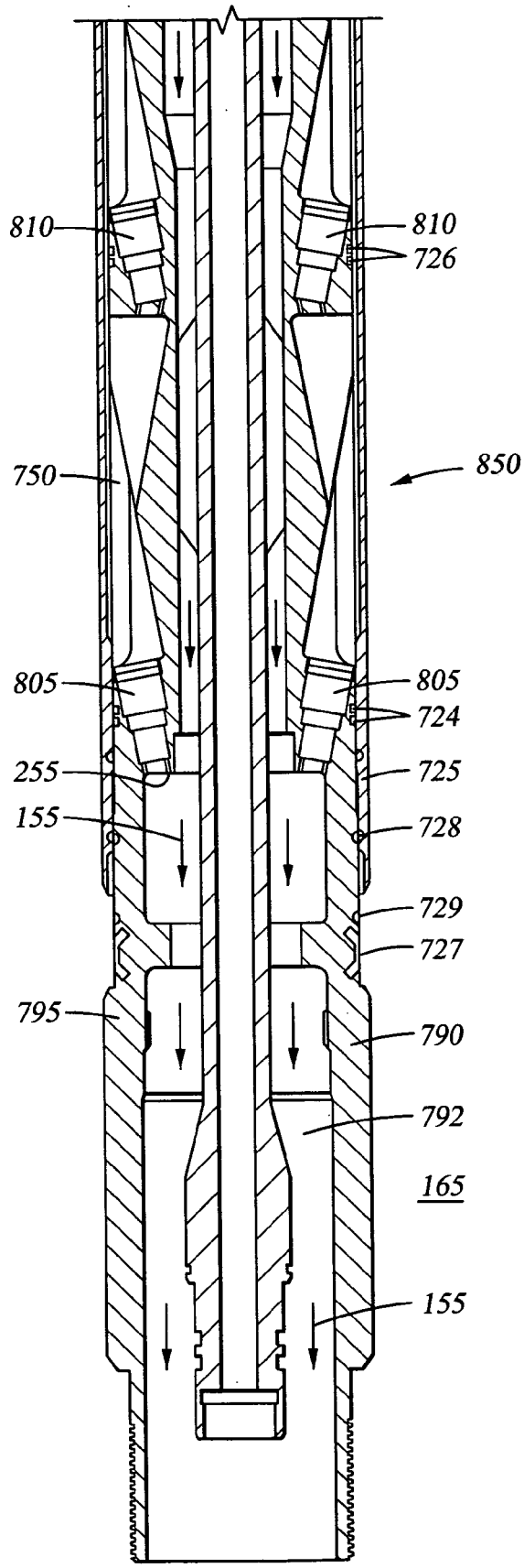
FIG. 52 is an enlarged, cross-sectional schematic of the lower portion of the embodiment of FIGS. 49 and 50 in the no-flow position.

FIGS. 51 and 52 provide enlarged, cross-sectional views of the upper and lower portions, respectively, of the alternate diverter sub 800 depicted in the no-flow position. In more detail, in the no-flow position, the locating sleeve 770 and the barrier cylinder 725 of the diverter sub 800 are shifted axially upwardly with respect to the lower housing 790. This feature enables the barrier cylinder 725 to cover the exit ports 460 and thereby prevent fluid from being diverted into the wellbore annulus 165 during operation. Alternatively, the barrier cylinder 725 may be shifted to cover the exit ports 460 at the drilling rig for purposes of flow testing to determine the size and type of nozzles 805, 810 that should be installed to achieve the desired pressure drop and flow rate.

To reposition the diverter sub 800 from the operational position of FIGS. 49 and 50 to the no-flow position of FIGS. 51 and 52, the locating sleeve 770 is shifted axially upwardly so as to expose seal 777, and then the sleeve 770 is held in position by driving a soft nail into axial groove 772 to provide a fixed connection between the sleeve 770 and the upper housing 710. The barrier cylinder 725 is then shifted axially upwardly until it extends over seal 777, thereby forming a sealed interface between the upper housing 710 and the barrier cylinder 725. Thus, the locating sleeve 770 functions to cover and protect the seal 777 when the diverter sub 800 is in the operational position of FIGS. 49 and 50, and then to expose the seal 777 so that the barrier cylinder 725 can engage it when the diverter sub 800 is in the no-flow position of FIGS. 51 and 52. The barrier cylinder 725 is held in position by driving a soft nail into axial groove 728 to provide a fixed connection between the barrier cylinder 725 and the lower housing 790.

With the diverter sub 800 in the no-flow position, a first flow test can be performed at the drilling rig to verify pressure drop versus flow rate through the drilling assembly 200. Then the diverter sub 800 can be repositioned to the operational position and the drilling assembly 200 can be lowered below the injectors 140 so that a second flow test can be performed to determine pressure drop versus flow rate through the drilling assembly 200 when a portion of the flow is being diverted. Using this method, the difference in flow rate through the drilling assembly 200 at a comparable pressure drop between the first flow test (diverter sub 800 in the no-flow position) and the second flow test (diverter sub 800 in the operational position) will indicate the diverted flow rate. If the diverted flow along path 190 is not within the range of desired flow rates, the nozzles 805, 810 of the diverter sub 800 can be exchanged as necessary. Thus, because the barrier cylinder 725 is axially shiftable to block off the exit ports 460 of the diverter sub 800, flow testing can be performed at the top of the well 170 on the rig floor without removing the diverter sub 800 from the drilling assembly 200 and without removing the drilling assembly 200 from the coiled tubing 150. As one of ordinary skill in the art will appreciate, the other embodiments of diverter subs 250, 300, 322, 400 that were previously described may also be modified to include a shiftable barrier cylinder 725 (or outer housing) so that flow through the exit ports 460 can be blocked off.

The preferred embodiments of the diverter subs 250, 300, 322, 400, 800 of the present invention should be capable of continuously diverting ten percent or more of the total flow 155 delivered to the drilling assembly 200 to carry cuttings 180 from a deviated wellbore 170 while drilling progresses. The various embodiments of diverter subs 250, 300, 322, 400, 800 are preferably rig adjustable so that while connected to the drilling assembly 200, and while the drilling assembly 200 is connected to the drill string 150, the diverted flow rate along path 190 can be adjusted in small increments such as, for example, 5 GPM or less. The diverter ports 255 are preferably adapted to be plugged off while connected to the drilling assembly 200 so that no fluid can be diverted therethrough. Alternatively, a shiftable housing 725 may be provided to open and close the exit ports 460 from the dissipating assemblies. The various embodiments of diverter subs 250, 300, 322, 400, 800 are preferably capable of diverting drilling fluid having solids up to 0.06 inch diameter without clogging, and the various embodiments of dissipating assemblies 325, 350, 352, 450, 850 preferably dissipate pressure differentials up to 2200 psi for extended periods of time, such as 100 hours or more, without eroding and without significant changes in flow rate of the diverted drilling fluid.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. An apparatus for removing cuttings from a deviated wellbore being drilled using a non-rotating drill string, comprising:

a diverter that directs a fluid through a dissipater and into said deviated wellbore to remove cuttings while drilling of said wellbore progresses;

wherein said dissipater expends a pressure differential as said fluid flows therethrough.

2. The apparatus of claim 1 further including at least one screen for limiting the size of solids flowing into said diverter.

3. The apparatus of claim 1 further including a plug that prevents flow through said diverter.

4. The apparatus of claim 3 wherein said plug is disposed within a threaded sleeve.

5. The apparatus of claim 3 wherein said plug is secured in place by a snap ring.

6. The apparatus of claim 1 wherein said diverter comprises at least one port extending through a diverter wall.

7. The apparatus of claim 1 further including a controller for controlling the flow rate of said fluid.

8. The apparatus of claim 7 wherein said flow rate controller comprises one or more exchangeable nozzles.

9. The apparatus of claim 1 wherein said dissipater comprises at least one nozzle.

10. The apparatus of claim 9 wherein said nozzle includes a series of turns.

11. The apparatus of claim 9 wherein said nozzle includes a curved path having a continuous radius.

12. The apparatus of claim 9 wherein said nozzle includes a straight path having a substantially constant height.

13. The apparatus of claim 9 wherein said nozzle has a widening diameter.

14. The apparatus of claim 9 wherein said nozzle includes a straight path having a substantially constant width.

15. The apparatus of claim 9 wherein said nozzle is held in position by a snap ring.

16. The apparatus of claim 9 wherein said nozzle is threaded into position.

17. The apparatus of claim 9 wherein said nozzle is disposed within a threaded sleeve.

18. The apparatus of claim 9 wherein said nozzle is formed of a mold material.

19. The apparatus of claim 18 wherein said mold material is coated with a spray-on hardmetal.

20. The apparatus of claim 18 wherein said mold material is sand.

21. The apparatus of claim 18 wherein said mold material is glass.

22. The apparatus of claim 9 wherein said nozzle is formed of tungsten carbide.

23. The apparatus of claim 1 wherein said dissipater comprises a tortuous pathway.

24. The apparatus of claim 23 wherein the tortuosity of said pathway is determined by the pressure differential expended through said dissipater.

25. The apparatus of claim 23 wherein said tortuous pathway comprises a barrier cylinder.

26. The apparatus of claim 23 wherein said tortuous pathway comprises at least one baffle sleeve having obstructions disposed therein.

27. The apparatus of claim 26 wherein said at least one baffle sleeve is disposed at an angle.

28. The apparatus of claim 23 wherein said tortuous pathway comprises protrusions extending between a first housing and a second housing.

29. The apparatus of claim 28 further including at least one port between said tortuous pathway and said wellbore.

30. The apparatus of claim 28 wherein said protrusions extend from a wall of said first housing.

31. The apparatus of claim 28 wherein said protrusions extend from a wall of said second housing.

32. The apparatus of claim 28 wherein said protrusions are formed of a hardened material.

33. The apparatus of claim 32 wherein said hardened material is tungsten carbide.

34. The apparatus of claim 28 wherein said protrusions are formed of steel coated with a hardened material.

35. The apparatus of claim 28 wherein said protrusions are diamond-shaped.

36. The apparatus of claim 28 wherein said protrusions are circular.

37. The apparatus of claim 28 wherein said protrusions are square.

38. The apparatus of claim 28 wherein said protrusions are rectangular.

39. The apparatus of claim 28 wherein said protrusions are triangular.

40. The apparatus of claim 28 wherein said protrusions are bullet-shaped.

41. The apparatus of claim 28 wherein at least one of said housings is formed of a hardened material.

42. The apparatus of claim 41 wherein said hardened material is tungsten carbide.

43. The apparatus of claim 28 wherein at least one of said housings is formed of steel having a hardmetal coating.

44. The apparatus of claim 28 wherein at least one of said housings further includes a hardmetal sleeve.

45. The apparatus of claim 28 further including a positioning assembly for maintaining an axial position of said second housing with respect to said first housing and enabling rotational movement therebetween.

46. The apparatus of claim 28 wherein said protrusions comprise an intermeshed pattern having an adjustable flow area.

47. The apparatus of claim 46 further including one or more channels to allow the passage of solids through said intermeshed pattern.

48. The apparatus of claim 46 wherein said intermeshed pattern is formed by connecting said first housing and said second housing via a multi-lead thread.

49. The apparatus of claim 46 further including a flow adjusting assembly for enabling a measured change to said adjustable flow area.

50. The apparatus of claim 49 wherein said flow adjusting assembly comprises an upper adjusting sleeve, a lower adjusting sleeve, and an adjusting housing.

51. The apparatus of claim 50 wherein said upper adjusting sleeve forms a first multi-position connection with said second housing and a second multi-position connection with said lower adjusting sleeve; said first and second connections having a different number of positions.

52. The apparatus of claim 50 wherein said lower adjusting sleeve forms a connection with said adjusting housing that enables axial movement and prevents rotational movement therebetween.

53. The apparatus of claim 1 further including a shiftable cylinder that allows or prevents flow through said diverter.

54. The apparatus of claim 53 further including a shiftable sleeve for protecting a seal when flow is allowed through said diverter.

55. The apparatus of claim 1 wherein said dissipater comprises a plurality of nozzles in series with a pressure drop chamber therebetween.

56. The apparatus of claim 1 further including an electronics housing.

57. A method for removing cuttings from a deviated wellbore comprising:

drilling the deviated wellbore using a drilling assembly connected to a non-rotating drill string, said drilling assembly powered by a fluid flowing therethrough;

diverting a portion of the fluid with a diverter away from the drilling assembly into the deviated wellbore at a flow rate corresponding to a velocity sufficient to remove cuttings while the drilling assembly drills the deviated wellbore; and expending a pressure differential as said diverted fluid flows through a dissipater.

58. The method of claim 57 further including adjusting the magnitude of the flow rate of the diverted fluid.

59. The method of claim 57 wherein the diverting occurs near a connection between the drilling assembly and the coiled tubing.

60. The method of claim 57 wherein the diverting occurs continuously while drilling.

61. The method of claim 57 further including screening the portion of the fluid as it is diverted into the wellbore.

62. A method for flow testing a diverter assembly having a flow bore and a diverter port comprising:

blocking the diverter port;

pumping a drilling fluid through the flow bore with the diverter port blocked;

measuring a first flow rate at a predetermined pressure drop of the drilling fluid through the diverter assembly;

opening the diverter port;

pumping drilling fluid through the flow bore with the diverter port open;

measuring a second flow rate at the predetermined pressure drop of the drilling fluid through the diverter assembly;

determining a diverted flow rate.

63. The method of claim 62 wherein blocking the diverter port comprises moving an outer cylinder to a first position with respect to an inner housing.

64. The method of claim 63 wherein opening the diverter port comprises moving the outer cylinder to a second position with respect to the inner housing.

65. The method of claim 63 further comprising moving a sleeve to expose a seal.

66. The method of claim 62 wherein all of the steps may be performed at the top of a well on a rig floor.

67. The method of claim 62 further comprising adjusting the diverted flow rate.

* * * * *